US005488380A

United States Patent [19]

Harvey et al.

[11] Patent Number: 5,488,380

[45] Date of Patent: Jan. 30, 1996

[54] PACKAGING ARCHITECTURE FOR PHASED ARRAYS

[75] Inventors: Donn T. Harvey, Issaquah; George W. Fitzsimmons, Kent, both of Wash.

[73] Assignee: The Boeing Company, Seattle, Wash.

[21] Appl. No.: 123,086

[22] Filed: Sep. 20, 1993

Related U.S. Application Data

[63] Continuation-in-part of Ser. No. 705,816, May 24, 1991, Pat. No. 5,276,455.

[51] Int. Cl.[6] ..... H01Q 3/22; H01Q 13/00; H01Q 21/00; H01P 1/00

[52] U.S. Cl. ..... 342/368; 342/372; 343/700 MS; 343/777; 343/853; 343/905; 333/248

[58] Field of Search ..... 342/368, 372; 343/700 MS, 824, 853, 859, 905, 906, 754, 777; 333/239, 24 C, 248, 254

[56] References Cited

U.S. PATENT DOCUMENTS

| | | | |
|---|---|---|---|
| 2,908,906 | 10/1959 | Kurtz | 343/777 |
| 3,623,112 | 11/1971 | Rupp et al. | 343/727 |
| 3,701,162 | 10/1972 | Seston et al. | 343/771 |
| 3,778,717 | 12/1973 | Okoshi et al. | 343/772 |
| 4,185,286 | 1/1980 | Drabowitch et al. | 343/754 |
| 4,356,497 | 10/1982 | Dudome | 343/771 |
| 4,573,056 | 2/1986 | Dudome et al. | 343/795 |
| 4,821,044 | 4/1989 | Kurtz | 343/771 |
| 4,825,220 | 4/1989 | Edward et al. | 343/795 |
| 4,878,060 | 10/1989 | Barbler et al. | 343/778 |
| 4,885,556 | 12/1989 | Lamberty et al. | 331/214 |
| 4,891,651 | 1/1990 | Steehlin et al. | 343/853 |
| 4,914,448 | 4/1990 | Otsuka et al. | 343/700 MS |
| 4,939,527 | 4/1990 | Lamberty et al. | 343/771 |
| 5,076,655 | 12/1991 | Bridges | 343/853 |
| 5,276,455 | 1/1994 | Fitzsimmons et al. | 343/777 |

OTHER PUBLICATIONS

Upton et al., "Monolithic HEMP LNAs in Radar, EW and COMM", 1988.

Yonaki, et al., "A Q–Band Monolithic Three–Stage Amplified", 1988.

Fulton, et al., "Electrical and Mechanical Properties of a Metal–Filled Polymer Composite for Interconnection and Testing Applications", 1989.

Akkapeddi, Kaushik S., "The Design of Some Novel 0.050–In. Grid High–Density Circuit Pack–to–Backplane Connectors", 1989.

Lambert, et al, "Use of Anisotropically Conductive Elastomers in High Density Separable Connectors", 1989.

Kinzel, et al., "V–Band, Space–Based Phased Arrays", Microwave Journal, Jan. 1987.

McIlvenna, John F., "Monolithic Phased Arrays for EHF Communications Terminals", Microwave Journal, Mar. 1988.

*Primary Examiner*—Gregory C. Issing
*Attorney, Agent, or Firm*—Foley & Lardner

[57] ABSTRACT

A dipole antenna is inserted into a waveguide to couple EM energy into and out of a waveguide. The dipole antenna is printed on a substrate of a module that contains electronic components. The substrate includes a coupled coplanar strip transmission line connecting the dipole antenna to a slotline. EM energy is electromagnetically coupled between the slotline and a microstrip transmission line. The EM energy is provided to and from the hermetically sealed electronic components by the microstrip transmission line.

19 Claims, 24 Drawing Sheets

RECTANGULAR WAVEGUIDE VIEW A

DIALECTRIC LOADED WAVE-GUIDE VIEW B

ANTIPODAL FINLINE-NON-OVERLAPPING FINS VIEW C

ANTIPODAL FINLINE-OVERLAPPING FINS VIEW D

MICROSTRIP LOADED WAVEGUIDE VIEW E

VIEW A

VIEW B

VIEW C

VIEW D

VIEW E

PACKAGING ARCHITECTURE FOR PHASED ARRAYS

This is a continuation-in-part of application Ser. No. 07/705,816, filed May 24, 1991, now U.S. Pat. No. 5,276,455.

FIELD OF THE INVENTION

The invention relates to phased array antenna structures, and more specifically to a communication system using extremely high frequency (EHF) phased arrays.

BACKGROUND OF THE INVENTION

Introduction

Planar phased-array antennas are constructed by arranging many, even thousands, of radiating elements spaced in a plane. In operation, the output of each element is controlled electronically. The superposition of the phase-controlled signals from the elements causes a beam pattern that can be steered without any physical movement of the antenna. Line arrays are also possible wherein a single row of antennas and modules make up a steerable array.

Electronically steerable phased array antennas at microwave and higher frequencies have had very limited use due to their high cost and due to difficulties of integrating the required electronics, radiating structures, and RF, DC, and logic distribution networks particularly at frequencies higher than 10 GHz. The spacing required between radiating elements for phased arrays that must steer over wide scan angles is on the order of ½ wavelength. The receive electronics or transmit electronics for each radiator must be installed within the projected area corresponding to the interelement spacing. In the case of radar, both receive and transmit electronics must occupy this limited space.

The array of radiating elements are generally protected at their interface with free space by a dielectric cover (radome) and/or a spatial filter, called a frequency selective surface. The electronics (usually in the form of modules containing amplifiers and phase shifters) are electrically connected to and located behind or beside the radiating elements. Networks are located in the same plane or behind the electronics to distribute RF, DC, and steering logic control. The packaging approach must also provide means for venting or controlling the unwanted thermal energy produced within the electronics.

Mechanical Integration

The overall problem of mechanically integrating the radiating elements, protective cover for the radiating element, electronics for each radiator, and low frequency interconnect and RF feed network in phased arrays is a difficult one. Furthermore, the problem becomes substantially more difficult as the operating frequency increases. Conventionally phased arrays are made using electronic modules which provide the phase shifting and amplification function. In most approaches, the array components (antennas, radomes, spatial filters, polarizers, electronics, distribution networks, etc) are physically layered over one another making it difficult to gain access to the electronic functions (modules) for rework and/or repair purposes. As the inter element spacing gets progressively smaller the room for conventional connectors disappears. Also, as the cross sectional area of each radiating element reduces, the path available for thermal transfer of excess heat reduces, thereby increasing competition for use of the available volume while decreasing options available for RF, DC and logic distribution.

Interconnects

Above approximately 10 GHz the space available for interconnect of RF, DC, and steering logic control at each phased array module becomes so small that conventional connectors or other custom contact-type interconnect means are not practical. Other problems associated with interconnects relate to accessibility of the wiring for soldering or welding. In addition, some assembly approach proposals prohibit future repair or replacement of modules without destroying the array.

RF Signal Distribution

The most critical of the signals distributed or collected within the phased array is the RF signal. The performance of the array requires that this signal to be at a prescribed value of the relative amplitude and phase. In addition, it is desirable for the RF distribution to be low loss so the gain within the modules may be minimized. Integration of such a low loss network with the assemblage of modules must be accomplished in a way that results in positive, reliable, phase repeatable interconnects, does not interfere with the DC and logic wiring, is compatible with thermal requirements, and retains the feature of module replacement. These attributes are difficult to achieve, particularly at higher frequencies.

Thermal Dissipation

Another significant problem in phased arrays is dissipation of heat generated by the active electronics. The capability of all designs, particularly with regard to the amount of transmit power that can be achieved, are limited by the ability to remove heat produced by the active electronics. As element spacing decreases, heat removal becomes an ever more important design criteria.

Hermetic Sealing

The requirement for hermetic sealing of the active electronics seriously restricts the choice of methods available for module fabrication. Plastic lids for semiconductors applied using organic adhesives or coatings are not permitted because organics do not form a true hermetic seal. The space required for the ceramic, glass, and metal associated with hermetic sealing reduces the space available for electronics. Additionally, the tolerances at high frequencies are tighter, usually precluding the use of layered ceramic, as-fired, substrates with metallization patterns applied in the green state due to the inaccuracies associated with predicting the shrinkage of the composite assembly.

Qualifications and Testing

Testing, tuning, and qualification of the phased array at the subassembly level has traditionally been an expensive process and, for some proposed packaging concepts, complete characterization of subassemblies is not possible. For phased array radar modules in production, the cost of tuning, testing, and qualification is estimated to be on the order of 10 times the module component and assembly cost according to comments by those knowledgeable in the industry. At millimeter wavelengths, where connectors are not practical, and input/output means are by way of soldering or other wire bond method, connections for RF testing and for burn-in may not only be costly, but, could risk damage to the module.

Specific Examples

In general, steerable phased array antennas usually require the transfer of array energy into and out of a multiplicity of antenna elements, often several thousand in number, each of which has an associated phase shifter with a transmitter amplifier and/or a receiver amplifier. Among the conventional approaches for distributing this energy are a corporate-fed array or a space-fed array, both of which are described in U.S. Pat. No. 4,939,527, incorporated herein by reference.

FIG. 1 shows a space-fed phased array 26. A simple feed horn 27 distributes energy to all antenna elements in an array by illuminating the back side of the array. Each antenna element 25 on the face of the array has a corresponding antenna element 28 that faces the feed horn 27 to receive this energy. Individual phase adjustments are made in the plurality of electronics modules 22 which enable the steerable characteristic of the array. Each electronics module 22 comprises two antenna elements 25 and 28, a phase shifter 23, and an amplifier 24.

The principal disadvantage of a space-fed array 26 is the relatively large spatial distance between the feed horn 27 and the array and thus the resulting physical thickness of the array assembly. Typically, this spatial distance is equal to half the array diameter. This disadvantage may be eliminated by using a quasi-space-fed distribution network as shown in FIGS. 2, 3A and 3B.

FIG. 2 shows a schematic diagram of a side view of such a quasi-space-fed array which uses an end-fed slotted waveguide array distribution network 51 which is per se more particularly shown in FIGS. 3A and 3B. The phased array antenna consists of a planar array of a plurality of electronic modules 22. The slotted waveguide array distribution network 51 is formed by an ensemble 52 of parallel waveguides having radial coupling slots. Network 51 is arranged in parallel to the planar array of electronic modules 22. The array of electronic modules 22, comprising phase shifters 23, amplifiers 24, antenna elements 25, and receptors 28', generates equiphase fronts of radiation. The array of electronics modules 22 is fed by the slotted waveguide array distribution network 51 of FIGS. 3A and 3B. Radiation exits the ensemble 52 of parallel waveguides through the radiating slots, which are adjacent each electronics module in the array. An energy receptor 28' at the face of each electronics module receives the radiation from the radiation slots. Energy receptors 28' can be slots, open ended waveguides, small antennas or other of a variety of devices known to practitioners in the field of microwave circuits and antennas. Each electronics module 22 can comprise a replacement pellet as shown in FIGS. 4 and 5 and described more particularly below.

FIG. 3A shows a front view of the distribution network 51. Ensemble 52 of waveguides is fed from one end by an excitation waveguide 53. Both ends of the waveguides of the ensemble 52 are terminated in waveguide loads 54, as is the output end of the excitation waveguide 53. These loads 54 are used to absorb residual energy and to prevent build-up of frequency sensitive standing waves in the waveguides of the ensemble 52. Rather than standing waves, a traveling wave propagation mode is thus produced.

The excitation waveguide 53 includes an excitation waveguide flange 55 and the waveguide load 54. The excitation waveguide 53 propagates energy through slots 56 in the excitation waveguide 53 to the ensemble 52 of parallel waveguides. Cover plate 57 forms a composite interface wall for all the waveguides in the ensemble 52. Each of the ensemble 52 of parallel waveguides have slots 58 that comprise radiating parallel shunt slots. These slots extent through the cover plate 57. Energy then propagates through the slots 58 of each of the ensemble 52 of parallel waveguides, through cover plate 57 which then couples radiation to each electronic module 22 in the phased array. The radiating slots of the cover plate 57 are adjacent each electronics module of the array. Energy receptor 28' at the face of each electronics module receives the radiation from the radiating slots of the thin cover plate.

FIG. 3B shows a side view of the distribution network 51 of FIG. 3A.

FIG. 4 shows a pellet 60 which contains the basic electronics of the electronics module 22 of FIG. 2. The phase shifting and amplifying circuit chips are contained on a circuit card comprising a ceramic substrate 64 installed on a pellet half-shell. The left end of he substrate 64 of FIG. 4 comprises wrap around connections 66 for DC power, logic connections and ground connections. These wrap around connections 66 can also comprise side-connections on the substrate 64. The substrate 64 supports two gallium arsenide monolithic microwave integrated circuits (MMICs) 68 and 70 and one silicon integrated circuit 72. The silicon integrated circuit 72, represents logic circuitry and may be installed as shown, atop the substrate 64. The gallium arsenide integrated circuits 68 and 70 are very high frequency circuits and are recessed into the substrate 64 to achieve a better impedance match. A laser, for example, may be used to cut the substrate 64 to accommodate recessing of the high frequency GaAs MMIC chips 68 and 70. Ultrasonic means are available which may also be used to machine holes within a ceramic substrate.

Two hermetic walls or seals 74 comprising two blocks of ceramic ($Al_2O_3$ alumina) sit atop the substrate in FIG. 4. The hermetic seals 74 are made either as thin as practical or they are made approximately ½ wavelength thick so that loss through the pellet 60 due to reflection coefficient and dissipative loss is a minimum. The hermetic seals 74 are fused to the substrate 64 at high temperature using a glass frit.

Because the temperature for firing the substrate 64 is high enough to destroy gold electrical connections, the only metallization pattern present on the ceramic substrate at the time of co-firing is adhesion metal. Adhesion metal is place under a gold outer layer to insure good adhesion between the conducting gold and the ceramic substrate. An example of an adhesion metal which tolerates the required firing temperature is tungsten.

In FIG. 4, the ceramic substrate 64 is equal in width to the whole pellet 60. The pellet halves are soldered down to metallization on the top and bottom of the ceramic substrate 64. In this manner, when the pellet 60 is completed, the edge of the substrate 64 is visible where the two halves of pellet meet.

FIGS. 5A, 5B, and 5C illustrate the pellet 60 or module package for a frequency range of 10 GHz to 100 GHz. The pellet 60 of FIGS. 5A, 5B, and 5C supports a transmitting phased array application, or a receiving phased array application; however, the pellet 60 could be applied to applications where both functions are included such as for radar.

The pellet 60 of FIG. 5A comprises a cylinder of rectangular cross section that propagates a waveguide mode at input and output ports. Two radiating coupling probes 80 and 82 are produced by printed circuit methods on a ceramic circuit card 84. These radiating probes 80 and 82 excite or receive the waveguide mode. The launcher pattern can be a printed probe for electric field coupling, a printed loop for magnetic field coupling, or a printed microstrip-to-slot line coupler that converts to finline. Radiation into the pellet 60 is via the lowest order waveguide mode directly through the end of cylinder. Energy is prevented from going around the cylinder or bypassing the cylinder by a choke joint 90 comprising a folded ¼ wavelength shorted stub at each end of the pellet 60.

The pellets 60 of FIGS. 5A, 5B, and 5C are fabricated out of thin metal stock, on the order of 0.005" thick, which is coated with a very thin (a few mil thick) dielectric 92. This dielectric 92 insures a small controlled space between the inner and outer layers of the choke joint 90 to prevent electrical shorting. When the pellet 60 is inserted into a receiving metallic hole, waveguide mode energy exiting or impinging on the pellet 60 can transfer with nearly 100% efficiency except for copper and dielectric losses. The end of the pellet 60 for array applications is too small to propagate and, therefore, to lower the cutoff frequency, the waveguide is dielectrically loaded, as shown in FIG. 5C. In some cases, the presence of the dielectric substrate is sufficient dielectric loading to permit propagation.

FIG. 5A shows a pellet long enough to accommodate the two choke joints 90, leaving adequate additional length for installation of the MMIC's 68 and 70 representing the required phase shifter, and amplifier circuitry and the logic integrated circuit (IC) 72. Such phase shifters, amplifiers, and logic circuitry are per se known in the art. The pellet 60 is made in two halves and the circuit card 84 and MMIC chips 68 and 70 are placed upon an electrical and thermal conductive support block 94 of FIG. 5B in the interior of the pellet 60. The low frequency contacts carrying the DC, ground, and logic input signals, exit the end of the pellet 60. These contacts may optionally wrap around and edge of the ceramic circuit card 84 and are electrically contacted using gold wire bonding.

FIG. 5B shows an end view of the pellet 60, with the ceramic hermetic seal 74 above a circuit substrate end, and the metal support block 94 and thermal heat sink under a circuit substrate.

The pellet 60 as set forth in FIGS. 4–5 is more particularly described in copending U.S. patent application, Ser. No. 07/337,185, filed Apr. 12, 1989 and entitled "Millimeter Wave Phased Array Pellet", incorporated herein by reference.

In the above systems individual modules are housed in a special pellet with integral choke joints built into each end. These modules are then inserted into a metal honeycomb waveguide structure. RF signals are conducted (radiated) into and out of the module without any metal-to-metal contact using the space fed array shown in FIG. 1. DC and logic control signals are routed to the individual modules using a multilayer printed circuit with the final connection being made by bonding several short flying leads between it and the module circuit card.

While the above systems may be useful, the module package fabrication including the hermetic seals represent a significant production cost challenge. Another challenge to the approach concerns the location of the flying leads for the DC and logic control wiring to the module. The leads are located within a region of high RF field at the end of the module. Careful lead dressing and impedance control on each end of these leads is expected to be necessary to minimize the RF pickup which could impact the performance of the imbedded module. Also, it will be observed that the only room available for the printed circuit wiring is within the space bounded by the waveguide walls. At high operating frequencies this space limitation becomes critical. For example, at 44 GHz, this channel width is on the order of 0.030 inches for a typical array capable of wide steering angles. This size limitation severely restricts the power supply conductor cross-section which limits the module DC current.

Waveguide Transitions

A common microstrip to waveguide transition is shown in FIGS. 2A and 2B. This transition is in a category of waveguide transitions that couple to the wave with a probe parallel to the electric field. The probe consists of a microstrip line 10 with the ground plane removed that extends into the waveguide parallel to the E-field. The RF energy is then coupled onto the probe. This transition would not be practical where coaxial implementations are required because of its non-coaxial implementation.

Another transition common in literature and practice is the waveguide to finline to microstrip transition. This transition is shown in FIGS. 2C–2D. This transition is formed from a microstrip line. The microstrip substrate is placed in the waveguide in the E-plane. The width of the microstrip line is gradually and non-symmetrically increased until it connects with one side of the wave guide wall. At the same time the ground plane tapers to one side and connects to the opposite waveguide wall forming an antipodal finline. The finline gap is then tapered to provide a smooth impedance transition to the waveguide. Some designs include a notch in the substrate to improve the discontinuity between the slab and air filled waveguide. This type of a transition has the advantage of being potentially broadband.

Transition from waveguide to microstrip using the antipodal fin-line approach is shown in FIG. 2B from the perspective of the transition and various plane cut views. FIGS. 2E–2I show the perspective from various transmission line media corresponding to plane cut views in FIGS. 2C and 2D. FIGS. 2J–2P show approximate electric field geometries and distributions corresponding to the guides in FIGS. 2E–2I.

The main problem with this transition is making the electrical connection with the waveguide walls for the finline sections. Another drawback is that in order to get the best performance the tapered sections must be multiple wavelengths long which leads to an unacceptable length for the phased array antenna. This transition also has no provision for transitioning into a hermetic package.

Another transition is shown is the ridged waveguide transition shown in FIGS. 2Q and 2R. This transition requires machining that may not be feasible in an economical array and it requires a solid mechanical and electrical connection to the microstrip substrate. A center conductor metal to metal contact is not practical for the small feature sizes required at millimeter wavelengths.

Maintenance

To maintain the performance of the phased array antenna during its life, it is desirable to allow replacement of individual modules which have degraded or failed. Electrical systems in general facilitate reparability by the use of sockets and connectors. A suspected component can be replaced in the field without special tools. Soldering or welding to repair or replace system components, which may cause heat damage, is not desired.

SUMMARY OF THE INVENTION

A primary object of the invention is to overcome the disadvantages of the prior art by providing a compact phased array structure for communications systems using high microwave frequencies.

In a transmission mode, the invention may be characterized as a phased array antenna structure having a distribution network, and a composite of feed, module, and antenna honeycomb structures. The distribution network distributes electromagnetic (EM) energy. The feed honeycomb structure is positioned adjacent the distribution network and connected to receive the EM energy from the distribution network. The module honeycomb structure is positioned adjacent the feed honeycomb structure so as to receive EM energy from said feed honeycomb structure. The antenna honeycomb structure is positioned adjacent the module honeycomb structure on a side opposite the feed honeycomb structure so as to receive EM energy from the module honeycomb structure. Each of the feed, module and antenna honeycomb structures have a plurality of aligned waveguides for transmitting EM energy therealong. The module honeycomb structure includes an electronic module for each waveguide, wherein each electronic module has an electronic element for adjusting at least the phase of the EM energy and transmitting the adjusted phase EM energy to the aligned waveguide of the antenna honeycomb structure.

In the receive mode, the invention may be characterized as a phased array antenna structure having a distribution network, and a composite of feed, module, and antenna honeycomb structures. The distribution network collects electromagnetic (EM) energy. The feed honeycomb structure is positioned adjacent the distribution network and connected to transmit the EM energy to the distribution network. The module honeycomb structure is positioned adjacent the feed honeycomb structure so as to transmit EM energy to the feed honeycomb structure. The antenna honeycomb structure is positioned adjacent the module honeycomb structure on a side opposite the feed honeycomb structure so as to receive EM energy from an exterior source and transmit same to the module honeycomb structure. Each of the feed, module and antenna honeycomb structures have a plurality of aligned waveguides for transmitting EM energy therealong. The module honeycomb structure includes an electronic module for each waveguide wherein each electronic module has an electronic element for adjusting at least the phase of the EM energy and transmitting the adjusted phase EM energy to the aligned waveguide of the feed honeycomb structure.

In the combined transmit/receive mode, the invention may be characterized as a phased array antenna structure having a distribution network, and a composite of feed, module, and antenna honeycomb structures. The distribution network is for distributing or collecting electromagnetic (EM) energy. The feed honeycomb structure is positioned adjacent the distribution network and connected to receive the EM energy from the distribution network or to distribute EM energy to the distribution network. The module honeycomb structure is positioned adjacent the feed honeycomb structure so as to receive EM energy from the feed honeycomb structure or to transmit EM energy to the feed honeycomb structure. The antenna honeycomb structure is positioned adjacent the module honeycomb structure on a side opposite the feed honeycomb structure so as to receive EM energy from the module honeycomb structure or to transmit EM energy to the module honeycomb structure. Each of the feed, module and antenna honeycomb structures have a plurality of aligned waveguides for transmitting EM energy therealong. The module honeycomb structure includes an electronic module for each waveguide wherein each electronic module has an electronic element for adjusting at least the phase of the EM emergy and transmitting the adjusted phase EM energy to the aligned waveguide of the antenna honeycomb structure or the feed honeycomb structure.

Another object of this invention is to provide an approach for RF coupling into and out of the module which is accomplished without the use of metal-to-metal contact. The approach of the instant invention electromagnetically couples the EM energy and no special tools or procedures are required to insert or remove the module. It is a further object to provide a reliable, low loss transition of the EM energy from the waveguide feed to the hermetically sealed microstrip circuitry of each of the modules. This transition must function at frequencies of up to 45 GHz. Due to the mechanical constraints of the array design, the transition must be coaxial with the waveguide and the module package. The design of this transition should facilitate ease of assembly as well as maintenance for the many modules required per antenna.

One preferred approach meeting these objectives includes a dipole antenna inserted into the waveguide to couple EM energy- between the waveguide and a slotline printed on the module and a slotline to microstrip transmission line transition to couple the EM energy between the slotline and the hermetically sealed module electronics.

In accordance with yet another aspect of the invention, the invention may be characterized as a phased array antenna structure having a distribution network, and a composite of feed, module, and antenna honeycomb structures. The distribution network is for distributing electromagnetic (EM) energy. The feed honeycomb structure is positioned adjacent the distribution network and connected to receive the EM energy from the distribution network. The module honeycomb structure is positioned adjacent the feed honeycomb structure so as to receive EM energy from the feed honeycomb structure. The antenna honeycomb structure is positioned adjacent the module honeycomb structure on a side opposite the feed honeycomb structure so as to receive EM energy from the module honeycomb structure. Each of the feed, module and antenna honeycomb structures have a plurality of aligned waveguides for transmitting EM energy therealong. The module honeycomb structure including an electronic module for each waveguide wherein each electronic module has an electronic element for adjusting at least the phase of the EM energy and transmitting the adjusted phase EM energy to the aligned waveguide of the antenna honeycomb structure. A multilayer wiring circuit is also provided and is positioned between at least one of (1) the feed honeycomb structure and the module honeycomb structure and (2) the antenna honeycomb structure and the module honeycomb structure, for providing electrical signals to each of the electronic modules.

Each of the electronic modules comprises:

1) a substantially planar substrate for supporting the electronic element, the substrate having a top and bottom surface;
2) a carrier for supporting a portion of the bottom surface of the substrate;
3) at least one extension region formed as part of the substrate and extending beyond an end of the carrier and extending into one of the antenna honeycomb structure or the feed honeycomb structure;

4) the substrate having a metallization pattern on the top surface thereof for feeding the electronic signals thereto;
5) at least one extension region having a metallization area, connected to the metallization pattern on the top surface thereof and vias extending from the metallization area on the top surface of the substrate to the bottom surface thereof in the extension region for receiving the electrical signals; and
6) a plurality of module terminals connected to the bottom surface of the substrate in the at least one extension region thereof, each of the module terminals connected to the vias for providing the electrical signals to the electronic element of the electronic module.

The multilayer wiring circuit includes a plurality of wiring circuit terminals corresponding to and positioned adjacent the plurality of module terminals for each of the electronic modules. The wiring circuit terminals and the module terminals are operative to make electrical contact with one another when the multilayer wiring circuit is biased against the module honeycomb structure and thus to connect the electrical signals from the multilayer wiring circuits to the electronic element of the electronic modules, and to break electrical contact with one another when the multilayer wiring circuit is moved away from the module honeycomb structure.

In accordance with another aspect of the invention, the invention may be characterized as a phased array antenna structure having a distribution network, and a composite of feed, module, and antenna honeycomb structures. The distribution network is for distributing electromagnetic (EM) energy. The feed honeycomb structure is positioned adjacent the distribution network and connected to receive the EM energy from the distribution network. The module honeycomb structure is positioned adjacent the feed honeycomb structure so as to receive EM energy from the feed honeycomb structure. The antenna honeycomb structure is positioned adjacent the module honeycomb structure on a side opposite the feed honeycomb structure so as to receive EM energy from the module honeycomb structure. Each of the feed, module and antenna honeycomb structures have a plurality of aligned waveguides to transmitting EM energy therealong. The module honeycomb structure including an electronic module for each waveguide wherein each electronic module has an electronic element for adjusting at least the phase of the EM energy and transmitting the adjusted phase EM energy to the aligned waveguide of the antenna honeycomb structure. There is also provided a multilayer wiring circuit positioned between at least one of (1) the feed honeycomb structure and the module honeycomb structure and (2) the antenna honeycomb structure and the module honeycomb structure, for providing electrical signals to each of the electronic modules.

Each of the electronic modules comprises:
1) a substantially planar substrate for supporting the electronic element, the substrate having a top and bottom surface;
2) a carrier for supporting a portion of the bottom surface of the substrate;
3) at least one extension region formed as part of the substrate and extending beyond an end of the carrier and extending into one of the antenna honeycomb structure or the feed honeycomb structure;
4) the substrate having a metallization pattern on the top surface thereof for feeding the electronic signals thereto;
5) at least one extension region having a metallization area, connected to the metallization pattern on the top surface thereof and vias extending from the metallization area on the top surface of the substrate to the bottom surface thereof in the extension region for receiving the electrical signals; and
6) a plurality of module terminals connected to the bottom surface of the substrate in the at least one extension region thereof, each of the module terminals connected to the vias for providing the electrical signals to the electronic element of the electronic module.

The multilayer wiring circuit includes:
1) a plurality of wiring circuit terminals corresponding to and positioned adjacent the plurality of module terminals for each of the electronic modules,
2) an elastomeric wedge for each of the plurality of wiring circuit terminal, and
3) a plurality of metallic elements secured to the wedge, the metallic elements electrically insulated from one another.

The plurality of metallic elements of the wedge are positioned between the plurality of module terminals and the plurality of wiring circuit terminals to connect same when the wedge is biased against the plurality of module terminals and the plurality of wiring circuit terminals and to disconnect same when the wedge is not so biased.

BRIEF DESCRIPTION OF THE DRAWINGS

These and other features of the invention will become apparent from the detailed description to follow taken in conjunction with the drawings wherein.

DETAILED DESCRIPTION OF THE PREFERRED EMBODIMENTS

Overall Communication System

Figure 6A:
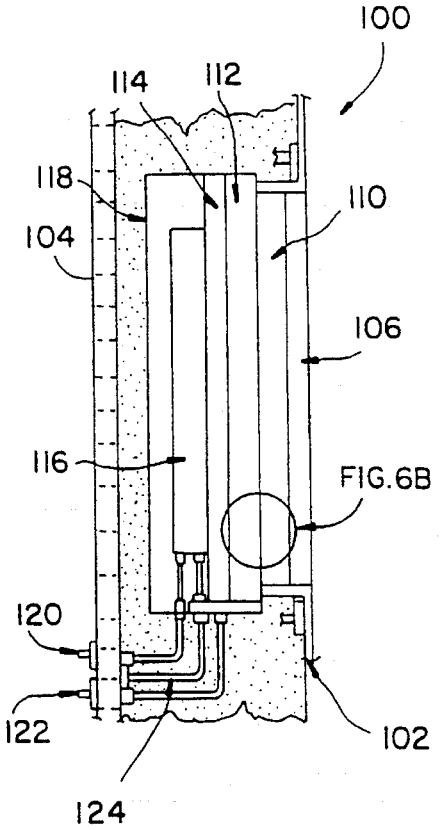
FIG. 6A–6D show the overall communications phased array in accordance with an embodiment of the invention.
Figure 6B:
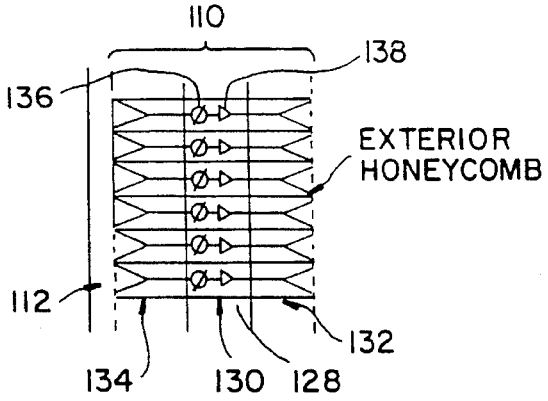
Figure 6C:
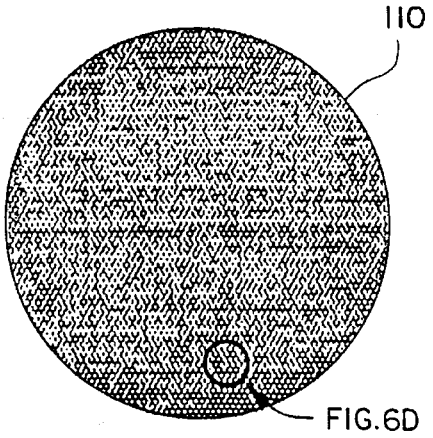
Figure 6D:
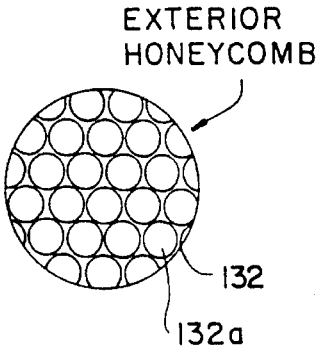
Figure 7:
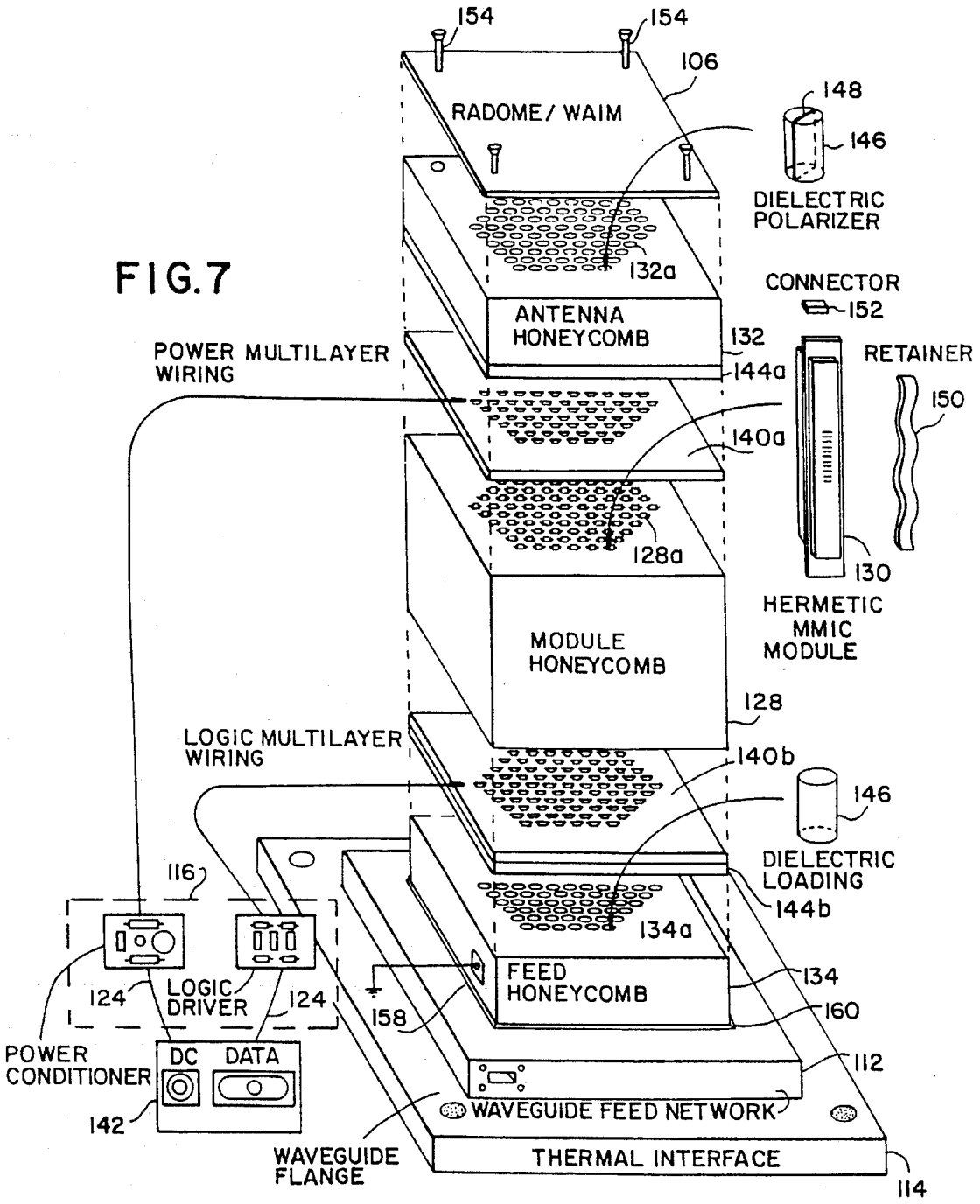
FIG. 7 illustrates an exploded view of a more detailed representation of the embodiment of FIG. 6.

FIGS. 6A–6D and 7 illustrate the overall communications phased array 100 in accordance with the principles of the invention. FIG. 7 is an exploded and more detailed view of the phased array of FIG. 6A. The illustrated phased array 100 is a 44 GHz transmit phased array, although the same principles apply for a receive array as well.

The phased array 100 may typically be installed within an aircraft and is designed to conform to the airplane external skin 102 so as to minimize drag. (See FIG. 6A). The array is positioned between the aircraft external skin 102 and the cabin interior pressure bulkhead 104. Looking first at FIG. 6A, the phased array 100 is seen to comprise a cover 106, honeycomb structure 110, waveguide feed network 112, heat exchanger 114, and power conditioning and logic driver circuits 116. The honeycomb structure 110 is made of a plurality of aligned tubes **110*a* which function as waveguides and as support structures. The cover 106 may comprise a wide angle impedance matching (WAIM) structure which is well known in the art. Moreover, the cover 106 may also include a conventional λ/4 Radome. The power conditioning and logic driver circuits 116 contain an upconverter, (for example 44 GHz upconverter) driver amplifier, dc power conditioning, and logic driver. A subsystem container 118 is used to house the entire system making a seal with the cover 106. This container 118 is charged with a gas, for example nitrogen, so that at sea level, the gas pressure is slightly higher than atmospheric pressure. The container 118 is sealed so as to prevent humidity from entering the system which would otherwise cause corrosion and energy loss at the microwave energies employed. It is noted if a Radome is utilized as part of the cover 106, it would serve as the exterior surface of the container 118** providing a seal so as to contain the gas therein. In utilizing the Radome, one would typically employ a foam layer between the WAIM structure and the Radome.

FIG. 6A also illustrates a transmit RF power input 120, coolant fittings 122 for enabling a liquid coolant, such as ethylene glycol, to be used in the heat exchanger 114, and power and logic cables 124. Although a liquid heat exchanger 114 is provided on the back of the phased array in FIG. 6, heat could also be dissipated, albeit less efficiently, through incorporation of an air driven heat exchanger. The heat exchanger could also make use of heat pipe technology. For some applications, the array may only require convection and conduction cooling via the mounting hardware, particularly in small arrays or in receive applications where power dissipation might be quite small. The power conditioning and logic driver circuits 116 clearly need not be physically positioned at the back of the heat exchanger 114, but could be alternately situated. A receive array would be constructed in a similar manner except a low noise (receiver) amplifier (LNA) followed by a receiver booster amplifier and downconverter would be provided on or near the back of the array.

The heart of the phased array 100 is the honeycomb structure 110 which is best illustrated in FIGS. 6B and 7 and is seen to comprise an electronic honeycomb 128 containing a plurality of electronic modules 130 which are sandwiched between an antenna honeycomb 132 and a feed honeycomb 134. Each of these honeycomb structures may be fabricated from a good thermally conductive material. Moreover, in the embodiment of the invention wherein ground is brought into the electronic module 130 via the honeycomb structures as at terminal 158 of FIG. 7, the honeycomb structures should also be good electrical conductors. The external openings of the honeycombs are dimensioned to serve as wave guides, each opening emitting an amplitude-and-phase-controlled amount of electromagnetic RF energy. The electronic modules 130 each include a phase shifter 136, an amplifier 138 and a logic circuit (not shown) as described in more detail below. The antenna honeycomb 132, module honeycomb 128 and feed honeycomb 134 each contain the same number of aligned plural cells or tubes (waveguides) identified a tubes **132*a*, 128*a* and 134*a*** respectively.

FIG. 6C illustrates a broadside cut of the honeycomb support structure 110. The number of individual honeycomb cells or tubes is not critical, and any number may be used which is suitable for the desired purpose and required power levels. For example, a 44 GHz transmitter may employ 4000 cells, and a 20 GHz structure, may employ 1500 cells. FIG. 6D shows an enlarged view of a portion of the antenna honeycomb 132 illustrating the individual antenna honeycomb tubes **132*a***.

FIG. 7 is an exploded and slightly more detailed illustration of the phased array 100. In this view, two multilayer wiring elements are illustrated. In one embodiment of the invention, a power multilayer wiring 140*a* supplies DC (+5 V, −5 V) and ground to each of the plurality of electronic modules 130, and a logic multilayer wiring 140*b* supplies clock, data and logic ground to each of the plurality of electronic modules 130. In another embodiment of the invention, the multilayer wirings 140*a*, 140*b* supply the DC and logic signals respectively, but ground is supplied via the honeycomb structures which are all electrically connected together and to a ground terminal 158. In addition to the power conditioning and logic driver circuits 116, FIG. 7 shows power and logic terminals 142 for the power and logic cables 124 of FIG. 6A.

Adjacent each multilayer wiring 140*a*, 140*b* is a pressure plate 144*a*, 144*b* respectively. In some embodiments of the invention, these pressure plates are used to ensure good electrical contact of the multilayer wiring to the terminals of the plurality of electrical modules 130 as explained below. In an alternate embodiment, the pressure plates may be directly layered with metallization patterns to connect each module with the requisite DC and logic signal. In still other embodiments, these pressure plates are not used, as for example, when pins are used on the electronic module as will become apparent from the detailed description below.

Within each antenna honeycomb tube 132*a* and feed honeycomb tube 134*a* is a dielectric 146. The dielectric is used to enable these small waveguides to propagate, and become a guiding waveguide for the electromagnetic energy. Further, a polarizer 148 may optionally be utilized within each antenna honeycomb tube 132*a*. Also illustrated are a retainer 150 used to help secure each electronic module 130 within its module honeycomb tube 128*a*, and a connector 152 used to ensure good electrical contact between the electronic module 130 and the multilayer wiring 140*a*, 140*b*. These elements are explained more fully below. Finally, the entire assembly may be secured together by means of bolts 154 passing through holes in all the honeycomb structures to permit facile assembly and disassembly of the modules for repair and module replacement.

Overall System Operation

Figure 1:
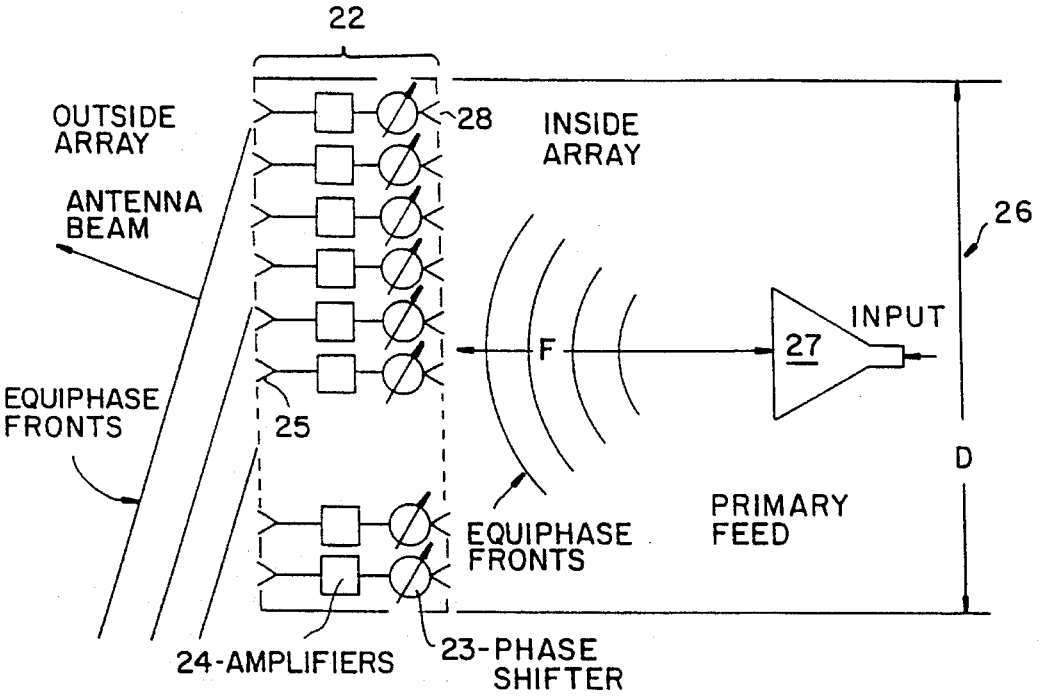
FIG. 1 PRIOR ART
FIG. 1 illustrates a prior art space-fed phased array structure.
Figure 2:
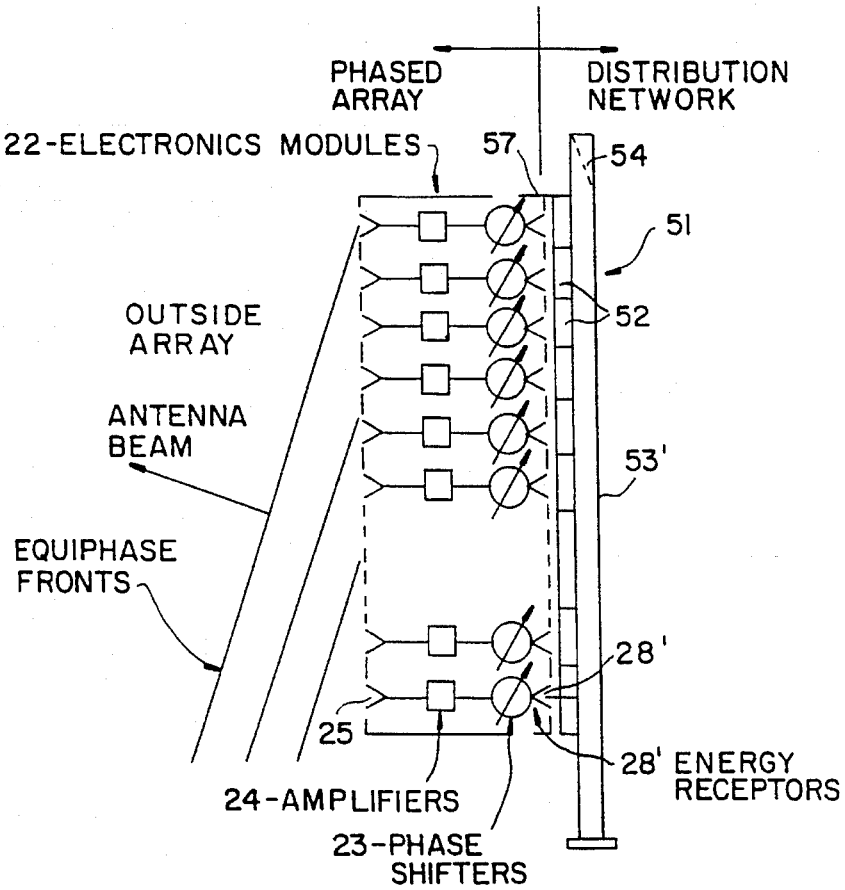
FIG. 2 PRIOR ART
FIG. 2 shows a side view of a quasi-space-fed phased array structure of the prior art.
Figure 2A:
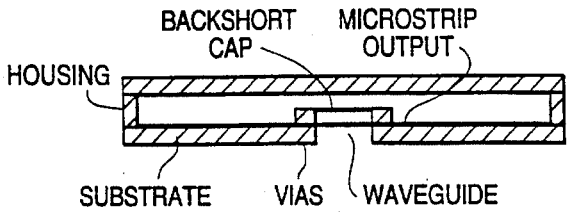
FIGS. 2A and 2B show a common microstrip to waveguide transition for RF coupling into and out of the waveguide.
Figure 2B:
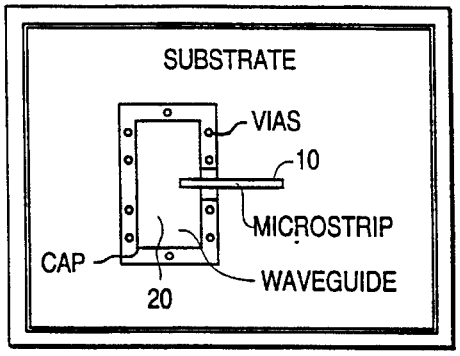
Figure 2C:
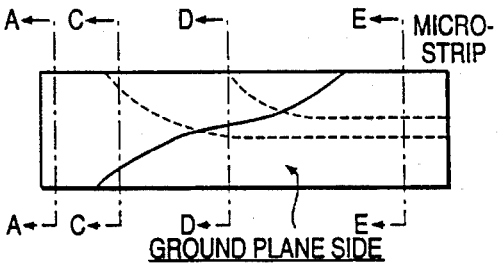
FIGS. 2C and 2D show an antipodal fin-line approach for RF coupling from the perspective of the transition and various plane cut views.
Figure 2D:
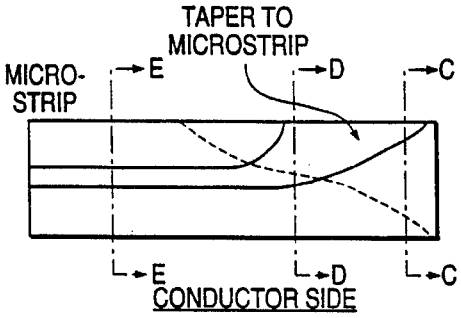
Figure 2E:
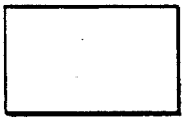
FIGS. 2E–2I show the perspective from various transmission line media corresponding to plane cut views in FIGS. 2C and 2D.
Figure 2F:
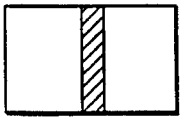
Figure 2G:
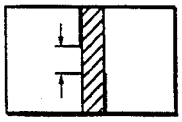
Figure 2H:
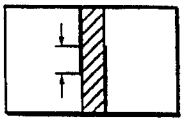
Figure 2I:
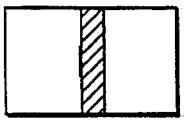
Figure 2J:
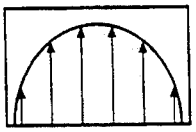
FIG. 2J–2P show approximate electric field geometries and distributions corresponding to the guides in FIGS. 2E–2I.
Figure 2K:
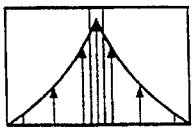
Figure 2L:
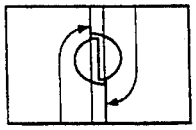
Figure 2M:
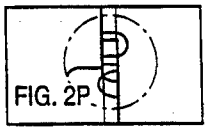
Figure 2N:
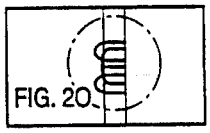
Figure 2O:
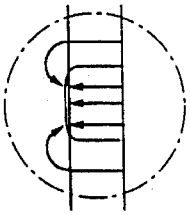
Figure 2P:
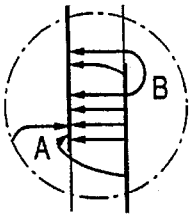
Figure 2Q:
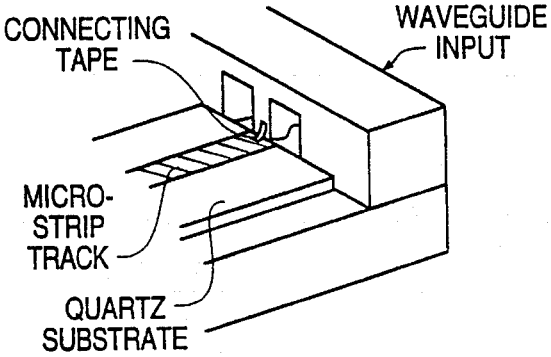
FIG. 2Q shows one view of the ridged waveguide transition.
Figure 2R:
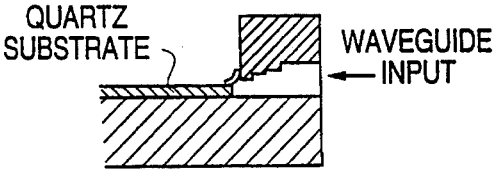
FIG. 2R shows another view of the ridged waveguide transition.
Figure 3A:
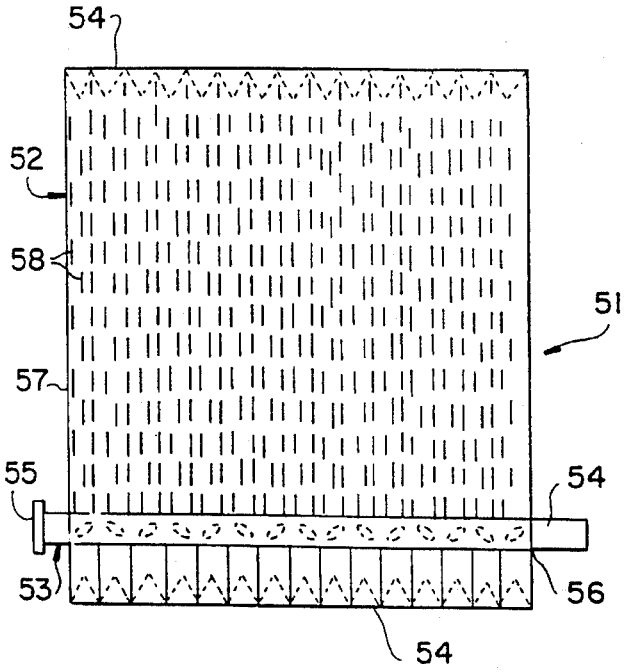
FIG. 3A PRIOR ART
FIGS. 3A and 3B show front and side views respectively of the distribution network of FIG. 2.
Figure 3B:
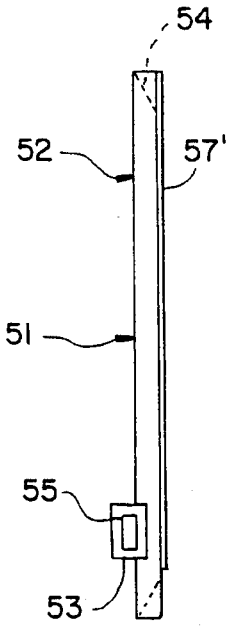
FIG. 3B PRIOR ART
Figure 4:
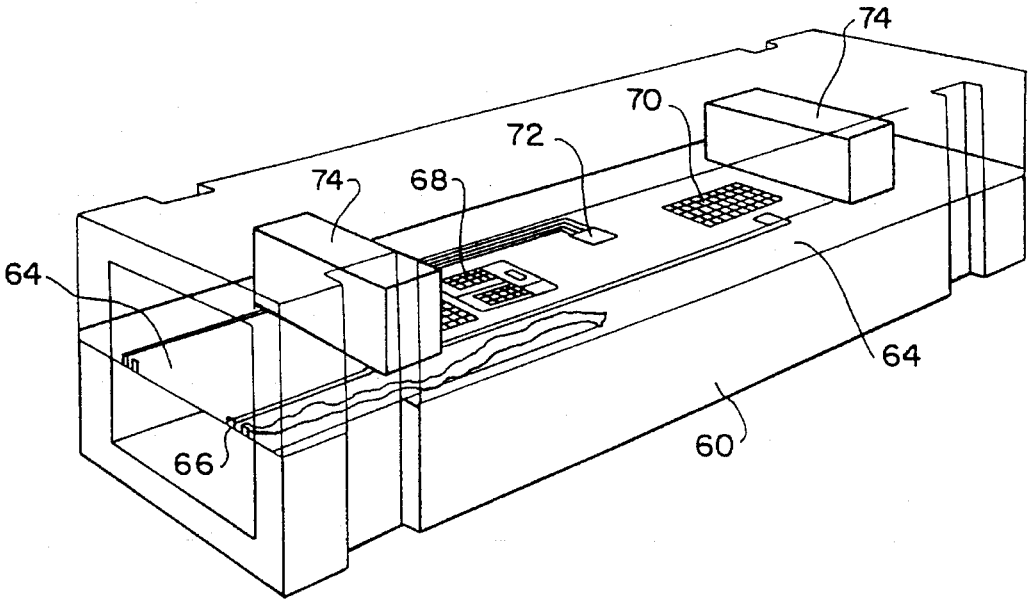
FIGS. 4, 5A–5C illustrate a pellet containing the electronic elements of the phase shift array as described in a co-pending application.
Figure 8:
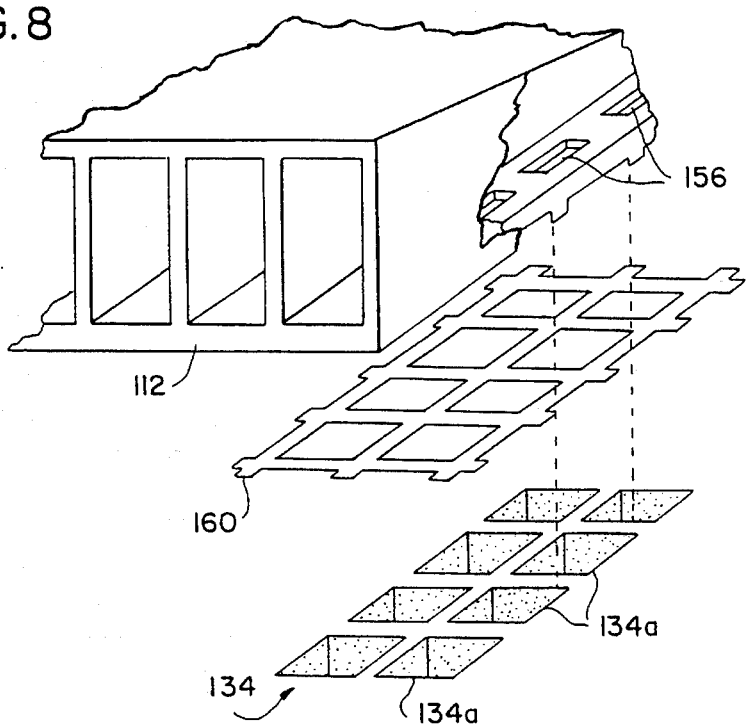
FIG. 8 depicts the connection of the waveguide feed network to the feed honeycomb of FIG. 7.

In operation, for the transmit phased array 100 as shown in FIGS. 6 and 7, the 44 GHz transmit signal enters the waveguide feed network 112 on the back of the feed honeycomb 134 and is distributed to each honeycomb tube 134*a* via slots 156 coupling out of each waveguide making up the waveguide feed network 112 as shown in FIG. 8. These slots serve the same function as the slots 58 shown in FIG. 3A. The waveguide feed network 112 is attached to the dielectric filled feed honeycomb 134 using dip brazing or by means of a silver-filled epoxy impregnated woven adhesive gasket 160. The waveguide feed network 112 and the feed honeycomb 134 typically supply equal RF levels to each electronic module 130, although some other predetermined amplitude distribution of the RF level may also be employed. The feed distribution may be the same as that illustrated in FIGS. 2, 3A and 3B above and described more completely in U.S. Pat. 4,939,527 incorporated herein by reference. Alternately, any of the well known distribution networks may be utilized such as those described in U.S. Pat. No. 4,939,527.

Figures 5A, 5B, 5C:
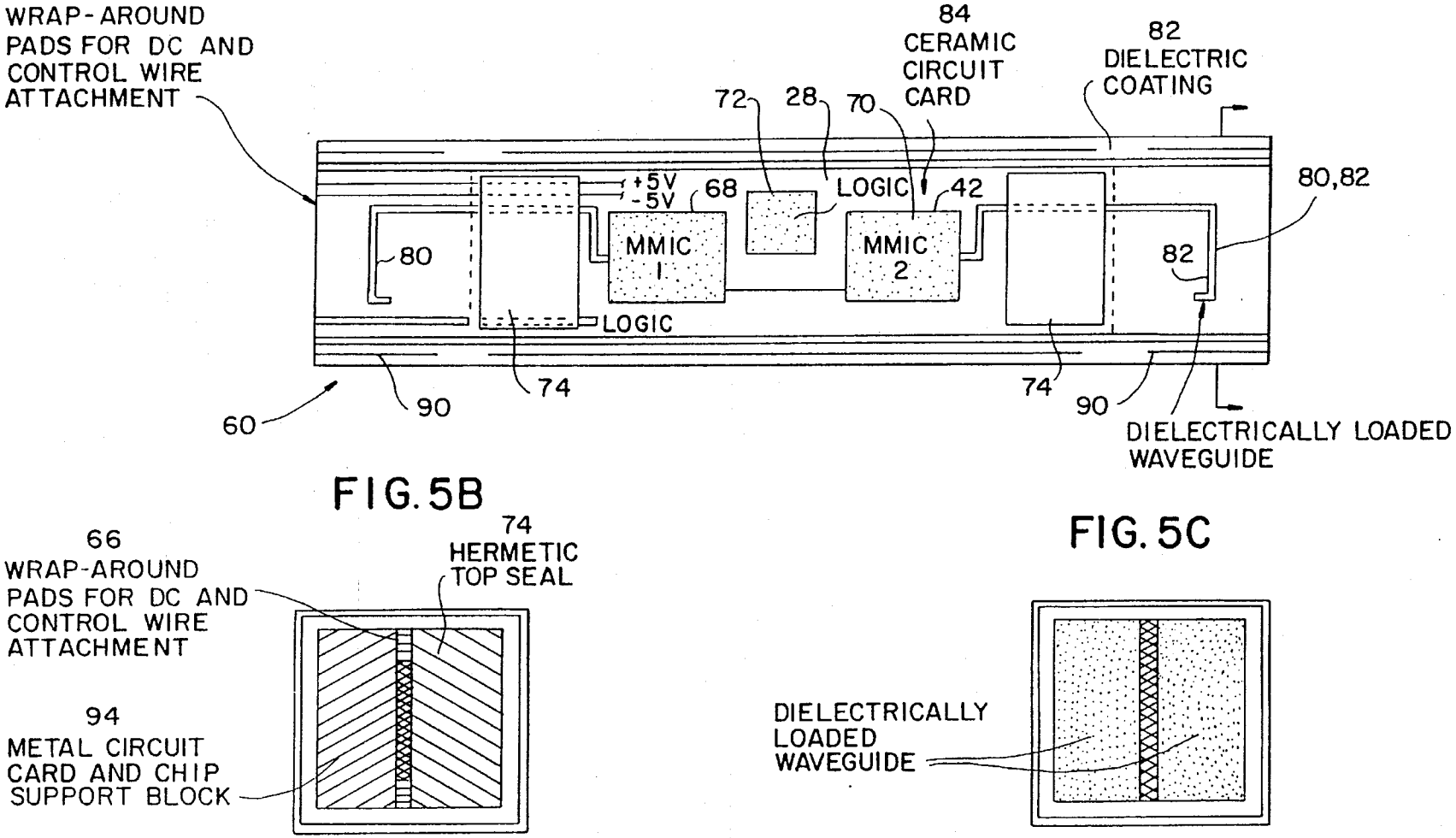

The dielectrically loaded honeycomb tubes 134*a*, 132*a* behave as waveguides to conduct the energy respectively to and from the electronic modules 130. The RF energy is coupled into the electronic modules 130 without metal-to-metal contacts using one of several types of couplers, the most common of which are a probe, a loop, or a finline transition coupler. These input/output couplers are part of the electronic module 130. The coupling means 30 used in the FIG. 5A is an illustration of probe coupling. The transmit signal is processed by the electronic module 130, amplified, phase shifted, etc., and passed out the other side of the module into an antenna honeycomb tube 132*a* using a similar noncontacting coupler means. Each of the exterior honeycomb openings operates as an antenna and radiates the electromagnetic signal adjusted by the electronic module 130.

Figure 14A:
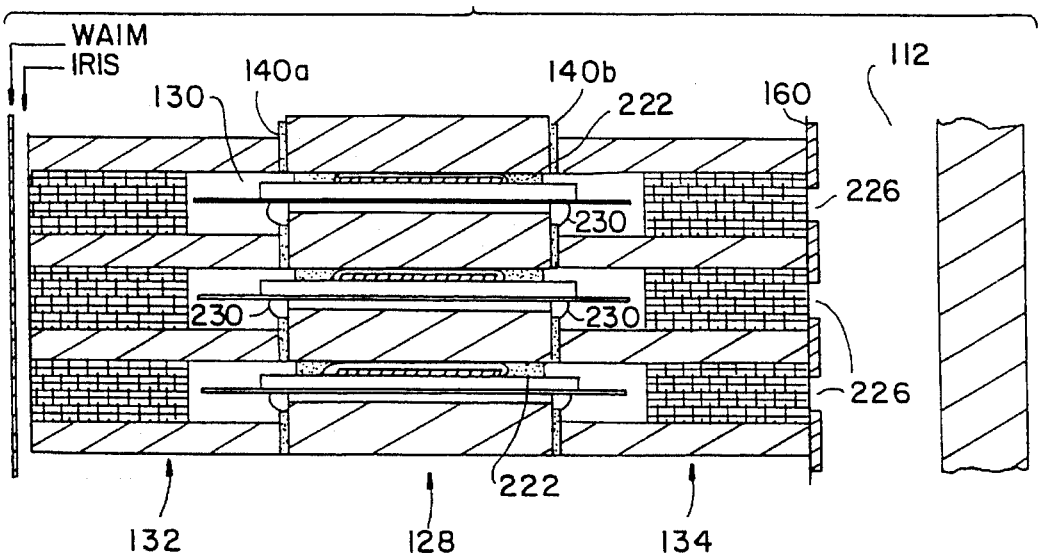
FIG. 14A shows a cross sectional view of the electronic module assembled between the feed and antenna honeycomb structures.

If the module-to-waveguide transition does not contain a circular polarization launching mechanism, the next function within the dielectrically loaded antenna honeycomb waveguide or tube 132*a* may, if desired, be that of polarization as effected by polarizer 148. A means for launching a circular polarization wave into the honeycomb tube directly out of the module is described in U.S. Pat. No. 4,885,556 incorporated herein by reference. After passing through the polarizer 148, the antenna honeycomb tube 132*a* guides the energy to the waveguide cover serving as a radiator. The radiating element is preferably impedance matched to the loaded antenna honeycomb tubes 132*a* over wide antenna scan angles by inclusion of an iris (restriction) at the end of the tubes 132*a* which is then covered by a dielectric sheet. This latter method of wide angle impedance matching (WAIM) is well understood by those skilled in the phased array antenna art. For example, WAIM 166 shown in FIG. 14A is held separated from iris 168 by a low dielectric constant filler layer (not shown). FIG. 6 completes the phased array 100 with a foam filler (not shown) followed by a radome to protect the array from the elements of weather and physical environment. The radome may include a meanderline polarizer which is another alternate means for achieving circular polarization.

It is understood that the structure shown in FIGS. 6 and 7 as well as the detailed structure of the electronic module 130 described below may be utilized as a receiving array rather than a transmitting array. Thus, the same structure shown in FIGS. 6 and 7 will also apply for a receiving array in which electromagnetic energy (such as microwave energy) is received in the antenna honeycomb 132 and passed through the module honeycomb 128 to the feed honeycomb 134 where it is then received in the waveguide feed network 112 and passed out the waveguide flange to downstream electronic receiving circuitry (not shown). Of course, the amplifiers within the electronic modules 130 must now be turned around so that the MMIC's are configured as receivers rather than transmitters in a manner well known in the art. However, the structural layout of the electronics module, remains the same for transmitter and receiver. Further, it is understood that with MMIC's designed for both receiving and transmitting, these structure shown in FIGS. 6 and 7 may be used as a unitary structure to achieve both a transmitting and receiving function generally using separate transmitting and receiving amplifiers or, at appropriate frequencies, a switch device with a common amplifier.

Electronic Modules—General Description

Figure 9A:
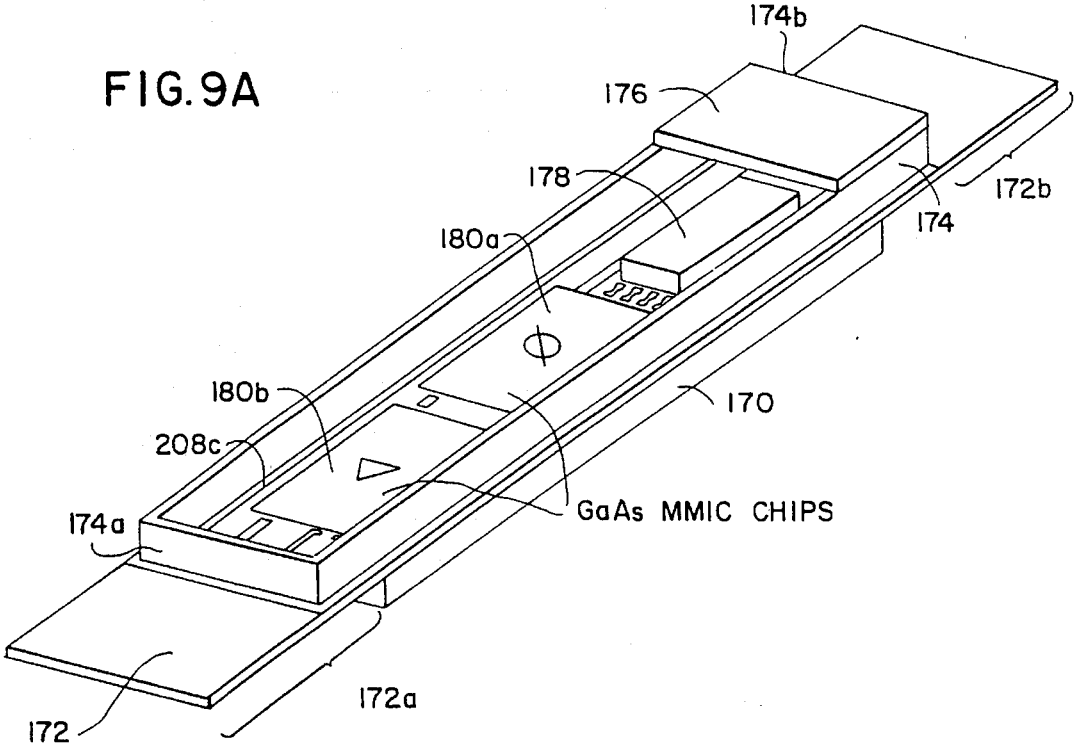
FIG. 9A illustrates a perspective view of an embodiment of the electronic module in accordance with the invention.
Figure 9B:
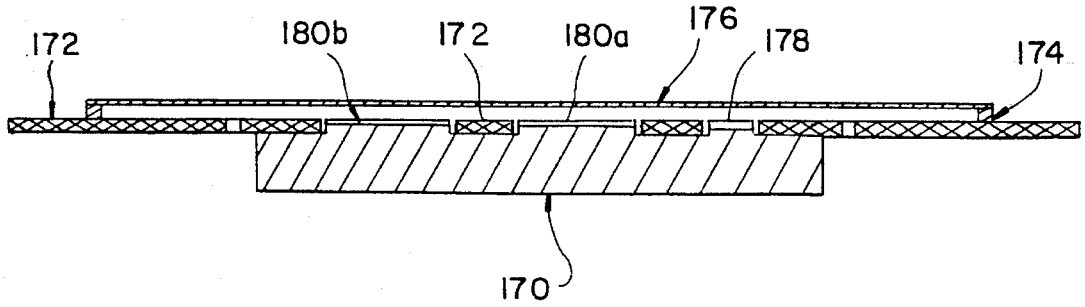
FIG. 9B is a longitudinal cross sectional view of the electronic module of FIG. 9A.
Figure 10:
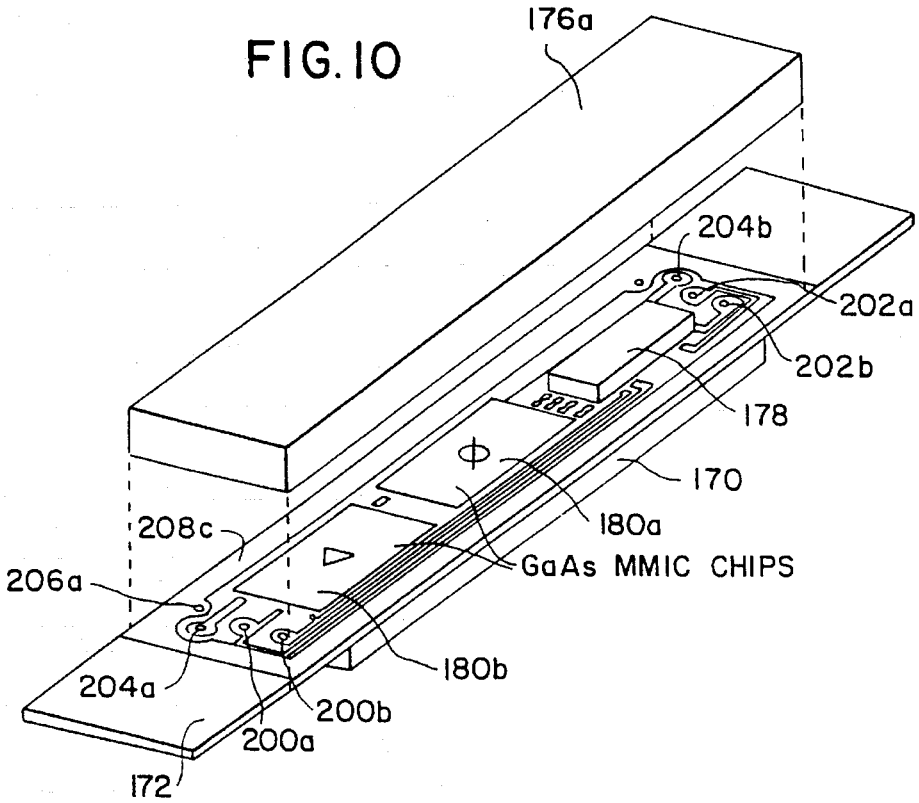
FIG. 10 is a perspective view of another embodiment of the electronic module.

FIGS. 9A, 9B and 10 illustrate a representative electronic module 130 which is similar to the module shown in FIG. 5A, but differs therefrom in significant structural characteristics which will become apparent from the discussion below and which are important features of the instant invention. As seen in FIG. 9A and the cross sectional view of FIG. 9B, the electronic module 130 is seen to comprise a carrier 170, substrate 172 having substrate Extensions 172*a* and 172*b*, seal ring 174, module lid 176, silicon logic chip 178, MMIC chip 180*a*, performing a phase shifting function and MMIC chip 180*b* performing an amplifying function. The MMIC chip 180*b* is positioned adjacent an antenna end 174*a* of the substrate 172, and the logic chip 178 is positioned adjacent a feed end 174*b* of the substrate 172. In FIG. 9A, a portion of the module lid 176 which forms a hermetic seal with the seal ring 174 is cut away to show the enclosed silicon logic chip 178 and MMIC chips 180*a* and 180*b*. These chips as well as terminals or pin connections discussed below are further illustrated in FIG. 10. The MMIC chips are preferable fabricated from GaAs or one of the other III–V compounds. In FIG. 10, the module lid 176 and seal ring 174 of FIG. 9A are replaced with a one piece cover 176*a* which includes a lid and a solder pre-form for facilitating soldering to the substrate.

The electronic module 130, apart from the electronics contained therein, comprises three relatively simple components. The longest component is the hard dielectric substrate 172, which may, for example, be made of alumina ($Al_2O_3$). The substrate 172 is attached to the second component which is the carrier 170 used to give mechanical support to the substrate 172 as well as to provide thermal and electrical characteristics to the honeycomb structure 110. The carrier 170 is thus both thermally and electrically conducting and may be made, for example, of gold plated Kovar. The substrate 172 is bonded to the- carrier 170 by soldering in those applications where hermetic sealing is required. Inorganic bonding agents such as silver-glass may also be suitable for hermetic substrate bonding applications. For non-hermetic applications, conducting epoxy may be used. The last component is a one-piece stamped module lid which is made of a metal, typically an iron-nickel-cobalt alloy which is then plated with gold. As shown in FIG. 9A, the module lid 176 is soldered down to a metallization ring 174 made of gold plated metal deposited on the substrate 172.

The volume inside of the module lid 176 (cover 176*a*) and above the carrier/substrate combination is the hermetically conditioned environment. In this space are positioned the two MMIC chips 180*a* and 180*b* and the logic chip 178. Chip 180*a* is the phase shifter MMIC for this cell or tube of the phased array. MMIC chip 180*b* amplifies the power to be radiated. This chip contains such things as transistors, resistors, inductors, capacitors, air bridges, and grounding vias. The MMIC chips may be fabricated to operate at the desired transmit and receive frequencies. Examples of MMIC's designed for millimeter-wave systems are described, for example, in J. Yonaki et al, "A Q-Band Monolithic Three-Stage Amplifier", IEEE 1988 Microwave and Millimeter-Wave Monolithic Circuits Symposium, pp. 91–94 and M.A.G. Upton et al, "Monolithic HEMTLNAS for Radar, EW, and Comm", IEEE 1989 Microwave and Millimeter-Wave Monolithic Circuits Symposium, pp. 105–109. Each of these chips 180*a* and 180*b* is shown recessed into rectangular cutouts in the substrate 172 as best seen from the cross sectional view of FIG. 9B in which the pins have been omitted for clarity. The substrate 172, may, for example, be made of 99% alumina and be approximately 10 mils thick, while the MMIC chips 180*a* and 180*b* are each approximately 4 mils thick. The carrier 170 is built up in the area of the MMIC's to bring the top surfaces of the MMIC's approximately flush with the top surface of the substrate 172. Recessing these semiconductors reduces the RF mismatch between the signal in the ceramic and the signal in the MMICs. The MMICs are conductively bonded to the carrier. The silicon logic chip 178 need not necessarily be recessed but is shown as such in FIG. 9B.

Module Metallization & RF, Power and Logic Interconnect

Figure 11A:
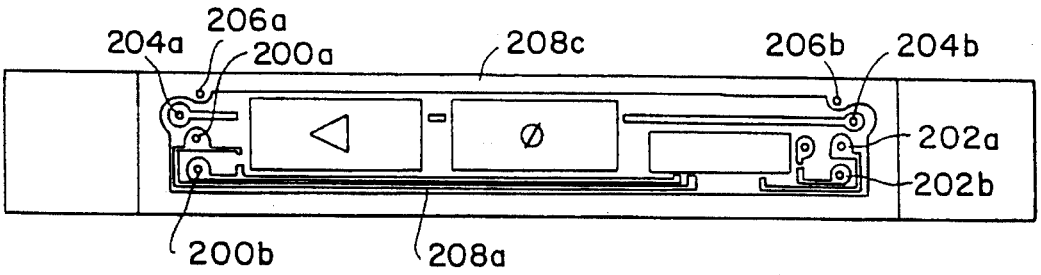
FIG. 11A is a plan view of the electronic module of FIG. 9A with the lid and seal ring removed.
Figure 11B:
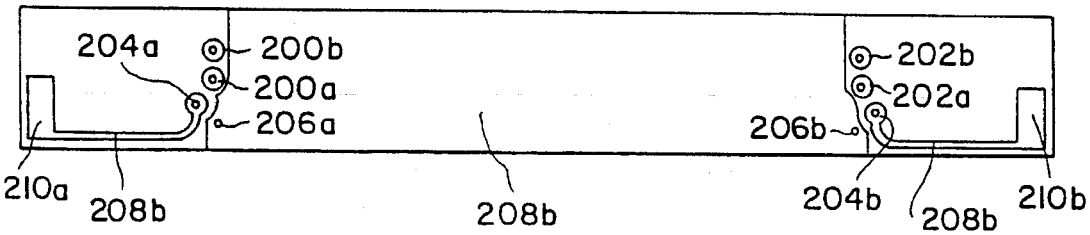
FIG. 11B is a bottom view of the electronic module of FIG. 9A.
Figure 12A:
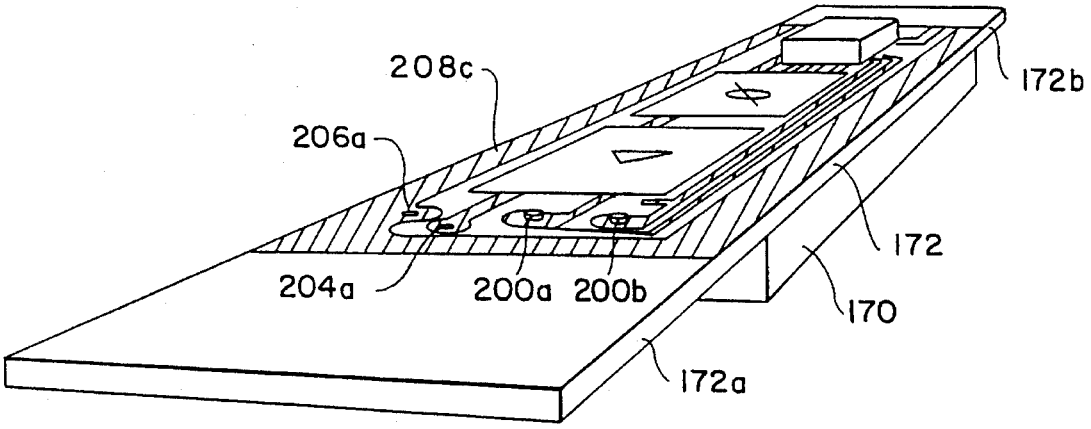
FIGS. 12A and 12B are enlarged perspective views of the electronic module of FIG. 9A showing top and bottom view of the extension region respectively.

As shown in FIGS. 11–12, at the end of the substrate adjacent the power MMiC chip 180*b* there is provided pins 200*a* and 200*b* which extent through vias in the substrate extension 172*a* to provide DC power to the circuit elements. At the end of the substrate adjacent the logic chip 178 there is similarly provided pins 202*a* and 202*b* which extent through vias in the substrate extension 172*b* to provide logic signals (clock and data signals) to the circuit elements. These pins are soldered or brazed in place to provide external attachment points. Filled vias suitable for providing hermetic sealing consist of plugs formed from sintered tungsten powder. Copper is dissolved into the plug forming a copper-tungsten hermetic seal. The pins provide a low cost means of providing connections outside the hermetically sealed module space for DC and logic. The external conduit for RF on each end of the module substrate 172 is through plated through vias 204*a* and 204*b*. These vias are holes which are plated full or solder filled. Additional vias 206*a* and 206*b* are provided to connect ground metallization from the top to the bottom surfaces of the substrate 172. Circuit and power ground (one and the same) may be connected from the body honeycomb structures 134, 128 as shown by terminal 158 in FIG. 7 since all of the honeycombs are electrically connected to the same ground.

The ceramic substrate 172 has patterned metal on both sides and incorporates plated through vias for grounding and for DC and logic input connections. Metallization pattern 208*a* is illustrated in FIG. 11A corresponding to the top pattern, and metallization pattern 208*b* is illustrated in FIG. 11B corresponding to the bottom pattern. In addition a ground metallization pattern 208*c* is illustrated on the top of the substrate 174 to which the module cover 176*a* (FIG. 10) or the seal ring 174 (FIG. 9A) are hermetically secured. These patterns are designed for the representative 44 GHz module substrate 172. The metallization consists, for example, of thin film metal plated up to the desired thickness with gold. The module lid 176 (cover 176*a*) is longer than the carrier 170 in order to provide sufficient overhang in the substrate extensions 172*a* and 172*b* to permit transfer of DC, and logic from the bottom side of the substrate 172 to the top side. For the transmitter function, the RF energy is transferred from the top side of the substrate (from MMIC 180*b*) to the bottom of the substrate in this same overhang area using the via 204*a*. RF energy is transferred into the electronics module 130 from the feed honeycomb 134 from the bottom surface of the substrate, in the region of substrate extension 172*b*, to the top surface using the via 204*b*. The RF mismatches introduced by the vias are tuned out over the frequency band of interest by appropriately shaping the metallization pattern for the RF paths as is well known in the art.

Figure 12B:
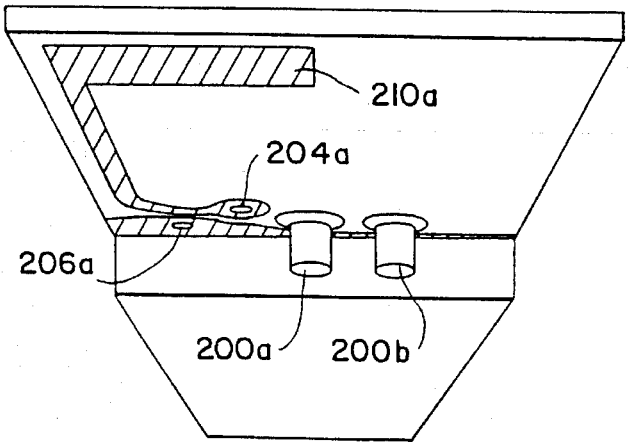

As best illustrated in FIGS. 11B and 12B, the bottom metallization pattern 208*b* includes printed (metal) electric field probes 210*a* and 210*b* used respectively to nonconductively couple the RF out of and into the electronic module 130.

In this RF coupling approach, an E-field probe transition, microstrip lines 210*a* and 210*b* are printed on the portion of substrate that is placed in the E-plane of the waveguide (parallel to the E-field of the lowest order mode). With the ground plane removed from behind the microstrip the line "hooks" into the waveguide parallel with the E-field to couple the Rf energy. The probe technique requires an identified means for transferring the probe feed ground to the waveguide walls.

A variation of the probe transition is the magnetic loop. In this transition the printed strip forms a loop between the microstrip line and the waveguide wall. This suffers from the same problems as the E-field probe.

Figure 13A:
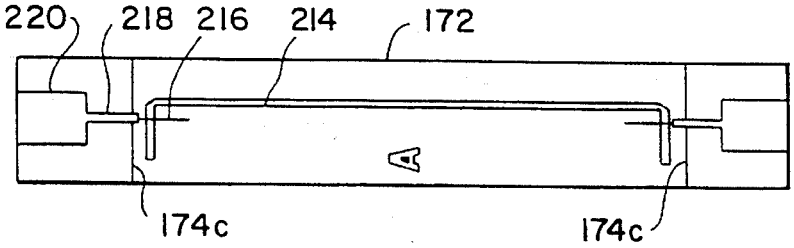
FIG. 13A depicts an alternate RF coupling mechanism for the electronic module using a microstrip and finline transformer.

Alternatively, the transfer may use other nonconducting coupling means. An example of a preferred alternate nonconducting coupling means where the signal transfers from one side of the ceramic circuit card to the other is the microstrip line to slot line band pass transition as illustrated in FIG. 13A. As illustrated, a microstrip line 214 is positioned, for example, on the top surface of the substrate 172 and a slotline 216, is positioned on the bottom surface. The slotline is joined to a slotline λ/4 transformer 218 and to a finline λ/4 transformer 220 (both on the bottom surface of substrate 172) in a conventional manner. No DC electrical contact exists between the microstrip line 214 and slotline 216. For simplicity of illustration, the MMICs 180*a* , 180*b* and the logic chip 178 have been omitted from FIG. 13A; however, the outer edge of the seal ring is indicated at 174*c* indicating that the hermetic space of the electronic module is between the two lines 174*c*. This technique is effective to couple into the hermetically sealed module. However, some connection 101 needs to connect the outside of the finline to the waveguide walls as shown in FIG. 13E.

Figure 13B:
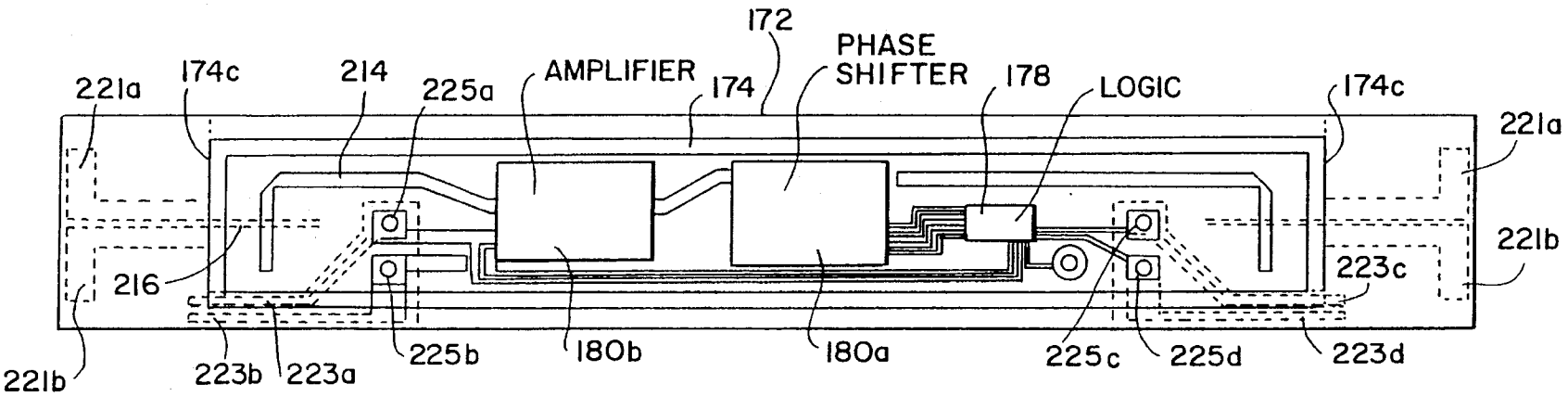
FIG. 13B is a plan view of a modification of the electronic module of FIG. 9A in which a dipole transmitter is employed and in which test probes are used.

FIG. 13B shows a plan view of another modification of the electronic module with its module cover removed and with a non-contact RF coupling utilizing a dipole antenna somewhat similar to that of FIG. 13A but with important advantages. In FIG. 13B, the dotted lines represent metallization patterns that are on the bottom surface of the substrate 172 whereas the solid lines represent structures and metallization patterns on the top surface of the substrate 172. As in FIG. 13A, a microstrip line 214 on the top surface of the substrate is coupled to a slotline 216 on the bottom surface thereof. Now however, a dipole antenna 221*a* and 221*b*, is utilized as a probe in the waveguide for coupling RF energy.

This waveguide to microstrip line 214 transition consists of two parts, a waveguide to slotline 216 transition and a slotline 216 to microstrip line 214 transition. The substrate 172 and thus the dipole antenna is placed into the E-Plane of the waveguide. The printed dipole elements 221*a* and 221*b* feed a coupled coplanar strip transmission line 221*c*. This line feeds printed slotline 216 which couples into microstrip line 214. It is important that the impedances of the slotline, coupled coplanar strip transmission line and the dipole feed point are matched as closely as possible to avoid reflections.

A broad band slotline to microstrip transition is utilized. This transition acts as a balun to convert the balanced slotline mode into an unbalanced microstrip mode. A detailed description of the microstrip to slotline transition is given in Knorr, Jeffrey, "Slot-Line Transitions," IEEE Transactions on Microwave Theory and Techniques, May 1974, pp. 548–554.

The dipole transition differs from other probe type transition because it does not require an electrical contact between the waveguide wall and the module. Because the dipole antenna is a balanced structure there is no ground. The ground is defined when the balun converts the signal from a balanced mode to an unbalanced mode in the module. With this type of probe the module can easily be inserted into the waveguide and reliable RF coupling can be made without the need for a special RF ground connection to the waveguide wall. This dipole technique lends itself perfectly to the application of a phased array .antenna since RF energy can be coupled into the hermetically sealed modules utilized in the phased array antenna. This technique is easily manufactured and facilitates assembly and repair since this transition approach requires no RF waveguide ground connection. The RF connection into and out of the modules is accomplished without the use of metal to metal contact. The module is electromagnetically coupled to the waveguide and no special tools or procedures are required to insert of remove the modules.

Figure 13C:
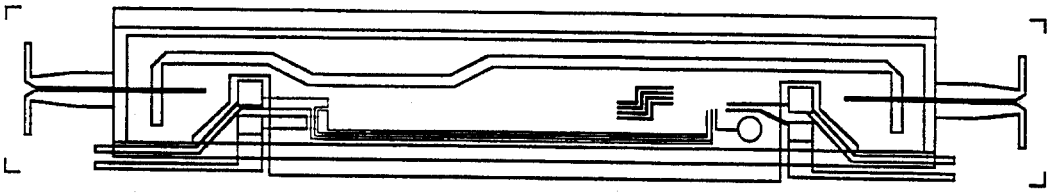
FIG. 13C shows a module as tested to prove the effectiveness of the dipole antenna in coupling EM energy into and out of a waveguide.
Figure 13D:
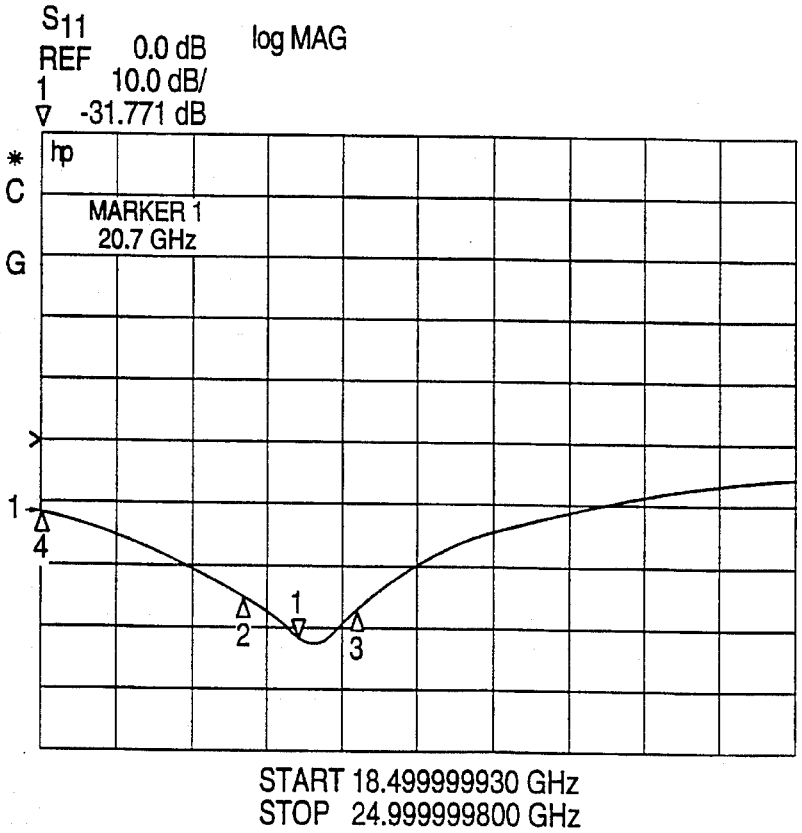
FIG. 13D shows the test results illustrating the effectiveness of the RF energy transition using the dipole antenna approach.
Figure 13E:
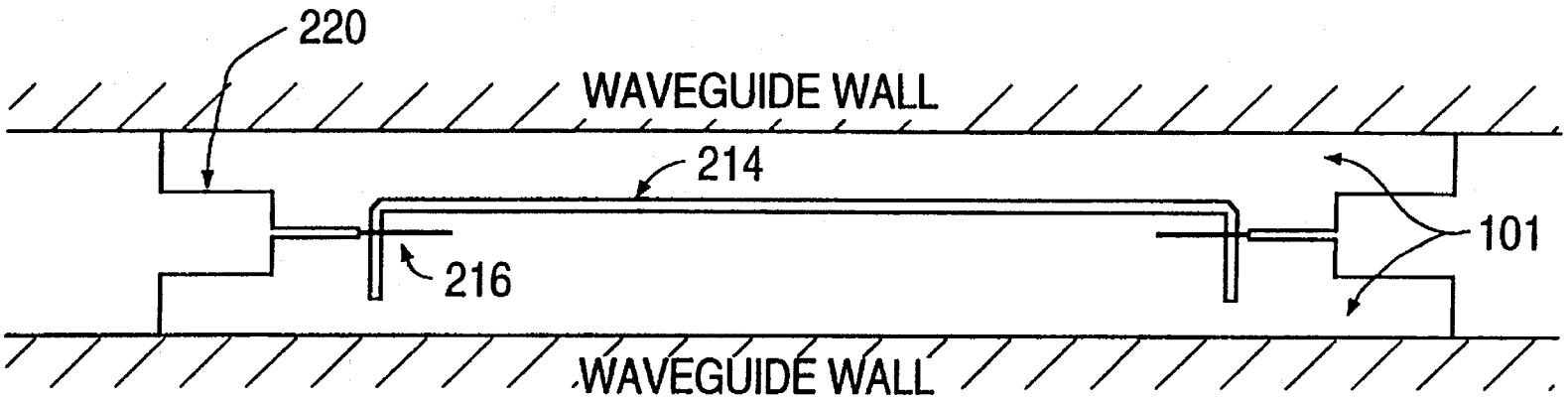
FIG. 13E shows the connection of the outside of the finline to the waveguide walls.

A back to back transition was fabricated as shown in FIG. 13C and was tested from 19 GHz to 25 GHz. The transition was designed to operate from 20.2 to 21.2 GHz. The results are shown in FIG. 13D. The S11 label in FIG. 13D for the Y axis refers to the scattering parameter matrix value row 1, column 1. The log MAG term specifies that the data shown is magnitude of the log base 10 of the scattering parameter. The log mag of S11 is more commonly known as the return loss which is a measure of the impedance match. The carrot mark on the y-axis denotes zero dB return loss. The grid is 10 dB per division so the plot shows that the return loss in the band of interest is about −15 dB which is quite acceptable for most applications.

This measurement is of the complete back to back circuit with the response of the first transition gated out in the time domain. The gated response is then reconvoluted to the frequency domain to give the frequency response of just the one transition. This measurement shows very little RF energy is reflected indicating a good transition into the microstrip line.

As further illustrated in FIG. 13B, metallization tips 223*a*–223*d* are provided on the bottom surface of the substrate 172 and connect through vias 225*a*–225*d* to the top surface of the substrate to provide test probes for the DC power and logic signals. These metallization tips 223*a*–223*d* extend out beyond the pressure plates 144*a*, 144*b* on each side of the electronic module 130 so as to enable measurement of the presence of the DC and logic (data and clock) before the antenna and feed honeycombs are attached. These metallization tips thus serve as test probes for the low frequency connectors.

It is pointed out that the dielectric elements (dielectrics 146) imbedded within the aligned waveguides of the antenna and feed honeycombs are chosen to give a good impedance match with the RF coupling device (probe, current loop, slotline etc.) carried on the substrate. More particularly, the dielectric constant and thickness of the substrate are selected in concert with the dielectric constant of the dielectrics 146 to provide a matched impedance for transmitting the electromagnetic energy into and out of the electronic module 130 at the desired operating frequency of said phased array antenna. In a representative example, the relative dielectric constant (relative to air) of the substrate 172 is 9.9, and the dielectric constant of the dielectric 146 is typically 2.54. Dielectric 146 may, for example, be made of a crosslinked polystyrene (e.g., Rexolite (TM) or other suitable material, such as PTFE (Teflon). A good impedance match is presented when the substrate 174 is 20 mils thick at operating frequencies of 20 GHz, and 10 mils thick at operating frequencies of 44 GHz.

Alternative Embodiment- Dielectric Seal Ring

For low frequency modules where more room is available than in the 20 GHz–44 GHz ranges, the seal ring 174 may be made of a ceramic and attached by either a low melting point glass frit or by soldering if all surfaces are properly metallized. If the seal ring is dielectric and is glass dielectric attached, connections between the outside and the inner hermetic space of the module 130 can be accomplished with metal (tungsten) conductor traces under the seal ring. In this case, hermetic vias may be omitted entirely. The logic and DC connections may be made on the bottom surface of the substrate as in FIGS. 11A, 11B but by using simpler, non-hermetic vias outside the hermetic space of the module. Moreover, the RF field probes 210*a*,b of FIGS. 11A, B may be positioned on the top surface of the substrate. Further, one may envision applications in which the logic and DC connections may also be made on the top surface of the substrate 174 thereby eliminating the need for all vias. The use of the dielectric seal ring is most practical for microwave frequencies at or below 10 GHz.

Component Materials

The carrier 170 and the module lid 176 (cover 176*a*) provide the required mechanical support for the substrate 172 and the electronic chips contained thereon. The carrier may be fabricated from Kovar, a compound that has a thermal expansion coefficient which matches alumina, the preferred composition of the substrate 172. Alternately, one may employ tungsten/copper, molybdenum, or compounds of aluminum silicon carbide which all exhibit a higher thermal and electrical conductivity than Kovar.

The module lid 176 (cover 176*a*) may be a one piece die formed metal cover which mechanically protects the circuit, provides the hermetic seal, and transports the mechanical forces required for module friction with the tube walls of the module honeycomb 128. The friction forces must be sufficient to insure the electronic module 130 does not move when subjected to the accelerations anticipated in aircraft, and it must be sufficient to insure good carrier thermal contact to the tube walls for efficient heat transfer. The lid material and design also must accommodate the coefficient of expansion characteristics of the lid relative to the ceramic substrate.

Honeycomb/Module Details

FIG. 14A contains a cross sectional view of an embodiment of the invention showing the RF portion of the entire phased array with the electronic modules 130 in place. This embodiment differs from that shown in FIG. 7 in omitting the pressure plates 144*a* and 144*b* as well as the connectors 152. These elements are omitted since the connections from the multilayer wirings 140*a* and 140*b* are made to terminals on the module substrate (e.g., see FIG. 12B) through wire bonds 230. Sufficient height is taken to illustrate three electronic modules 130. The modules 130 are held in place tight against the bottom of the module honeycomb tubes 128*a* by means of a memory metal wedge 222 which serves a similar function as the retainer 150 of FIG. 7. The memory metal wedge 222, as illustrated, is a two part module locking mechanism that exerts a predetermined force against the module.

In FIG. 14A, the feed honeycomb 134 is attached by brazing or with the conducting adhesive gasket 160 to the waveguide feed network 112. Waveguide energy is coupled into each of the tubes in the feed honeycomb 134 through the coupling slots 226. The amount of coupling is controlled by the slot design. FIG. 8 also illustrates the braze outline or gasket 160 and coupling slots 156.

Figure 14B:
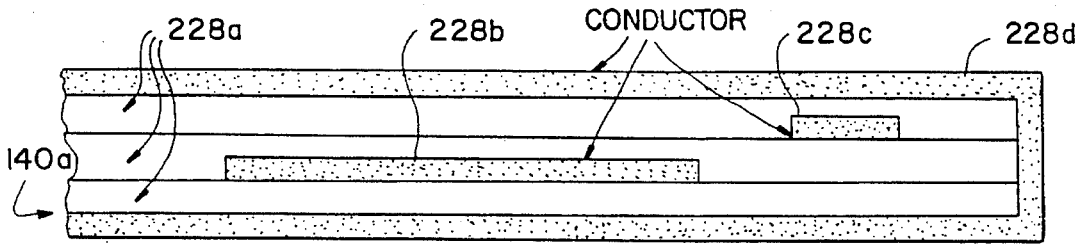
FIGS. 14B and 14C illustrate cross sectional end views of the multilayer wirings used in the invention.
Figure 14C:
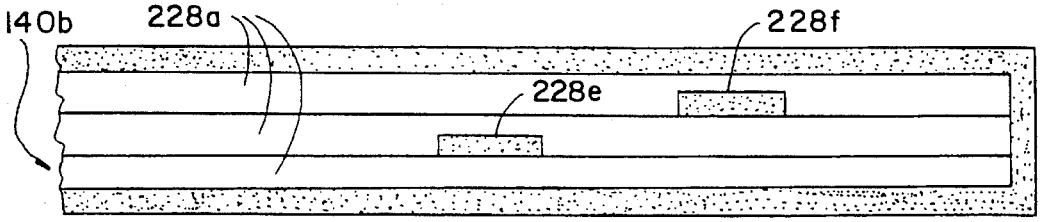

FIGS. 14B and 14C illustrate cross sectional views of the multilayer wiring 140*a* and 140*b* respectively. Insulating layers 228*a* separate the various metallization patterns carrying DC and logic within the multilayer wirings. Lines 228*b* and 228*c* are used for DC power; the outer metallic coating of the multilayer wiring is identified by 228*d;* and the data and clock lines of multilayer wiring 140*b* are identified at 228*e* and 228*f* respectively.

It is mentioned in passing that alternatively to providing two distinct multilayer wirings for power and logic, it would be possible to provide both power and logic on a single multilayer wiring positioned either in the position of multilayer wiring 140*a* or 140*b*.

Figure 15A:
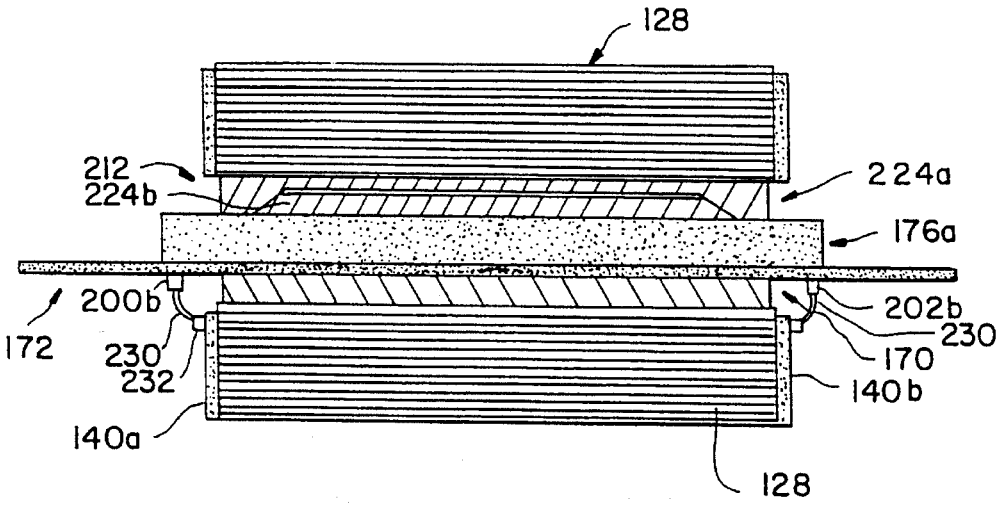
FIGS. 15A and 15B show -embodiments of memory metal wedges used in the invention.

FIG. 15A contains an enlargement of the module honeycomb 128 which illustrates the wedge 222 in more detail. The wedge 222 is fabricated from a class of material called shape memory alloys. The most common form of memory metal is nitinol, an alloy of nickel and titanium. These alloys have the ability to "remember" their original shape when heated to a predetermined temperature, even though the shape may originally be deformed up to 8%. The top portion 224*a* of the wedge is initially stretched approximately 0.030 inches prior to insertion, whereas a bottom portion 224*b* of the wedge 222 is not stretched. After insertion and warming to above the memory temperature, the top portion 224*a* will try to remember its original shape. It will shrink and bear on the shim chamfer of the bottom portion 224*b* which in turn exerts a predetermined force against the module 130. Other alternative memory metal geometries could be used. Also, there are other alternative methods (non-memory metal) that could be used for pinning the module in place as will be apparent to those skilled in the art.

The use of a memory metal attachment device is believed to be unique. The memory metal wedge 222 insures that the module 130 will not move until purposely pressed out at some future date for module removal. The memory metal wedge 222 also insures that the heat generated within the module will be efficiently removed by maintaining the pressure required to insure a low thermal resistance between the module and the honeycomb.

Figure 15B:
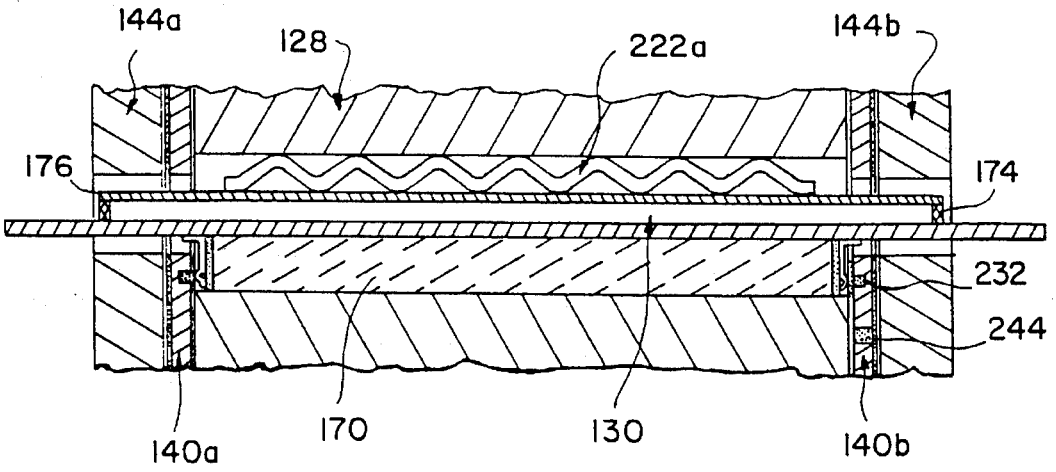

A modified memory metal wedge is shown in FIG. 15B. In this figure, wedge 222*a* is in the form of a corrugated strip. Strip 222*a* may, for example, be a few mils thick and as wide as the top of the module 130. At low temperatures, the strip 222*a* is stretched out to be substantially straight. The electronic module 130 is then inserted into the module honeycomb 128, and the strip 222*a* is inserted above it. Advantageously, both the module 130 and strip 222*a* are inserted with zero insertion force. The temperature of the assembly is then raised above the transition temperature where the strip begins to resume its original shape. The small channel space is filled by the expanding strip before it can fully resume its original shape resulting in a permanent force sufficient to accomplish module retention and efficient contact for thermal transfer. The strip 222*a* may be fabricated at low cost and the retention force is controllable by means of selecting the thickness of the material. Also illustrated in FIG. 15B is a spring like contact used instead of the wire bonds and terminals as is explained more fully below in relation to FIG. 18 and following.

Figure 16:
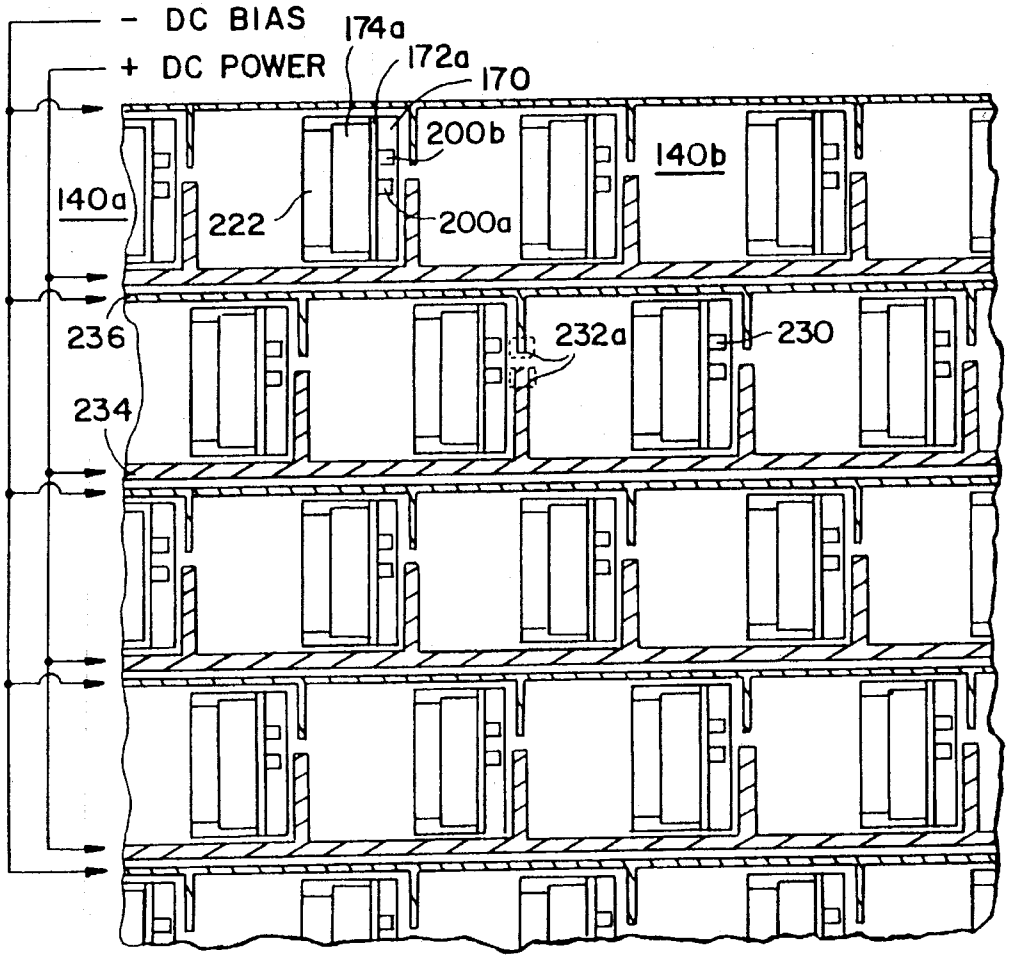
FIGS. 16 and 17 illustrate the metallization patterns on the multilayer wirings used in accordance with the invention.
Figure 17:
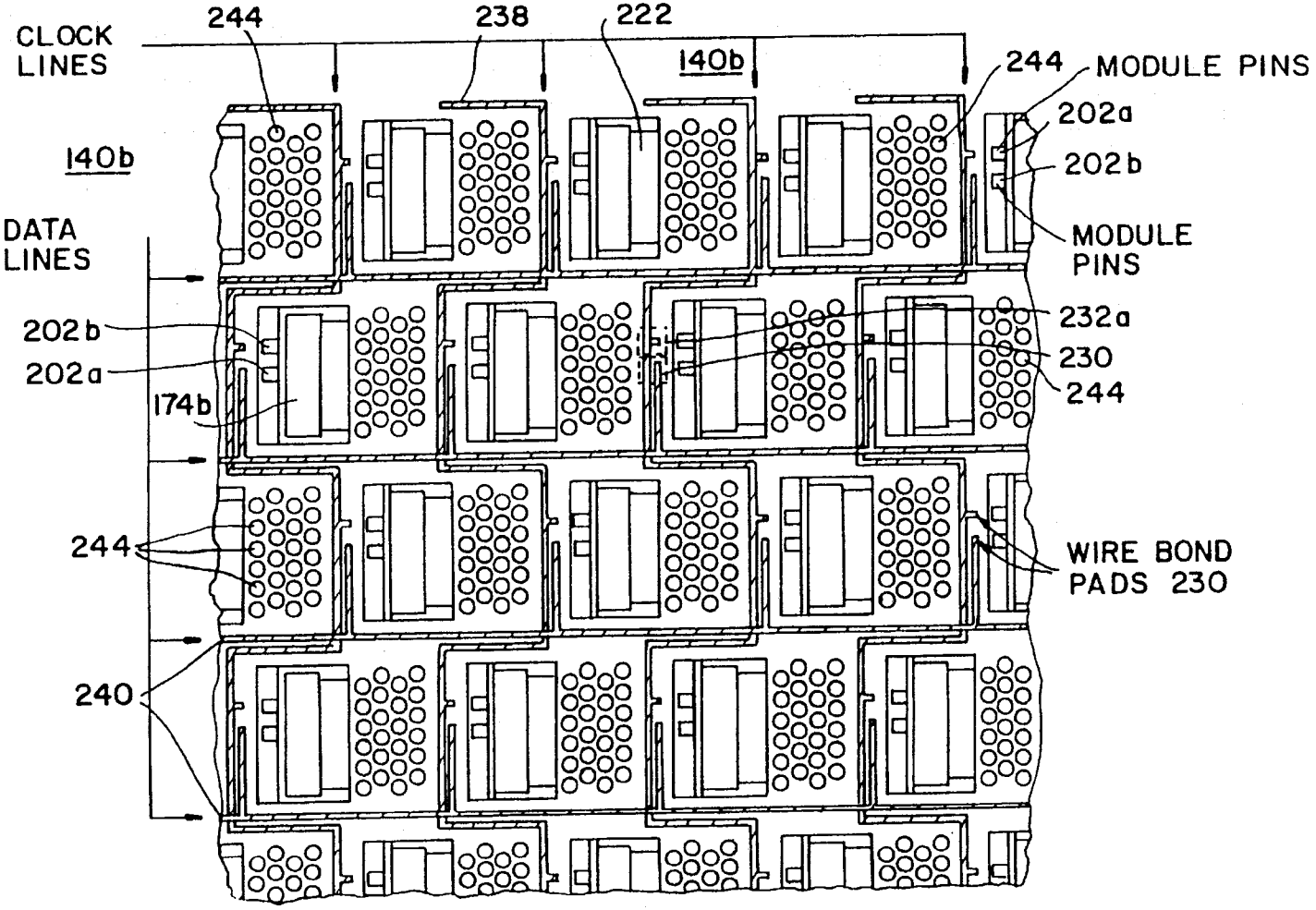

The individual honeycomb sections 128, 132, 134 may take any shape since each of them may be independently machined prior to assembly. The fabrication method of choice is wire electrical discharge machining (EDM). The embodiment of FIGS. 6 and 7 shows circular geometries for all three honeycombs. However, other configurations will be readily apparent to those of skill in the art. For example, a combination of square and rectangular geometries may be used as illustrated in FIGS. 16–18. As illustrated, the module honeycomb 128 may have a rectangular hole shape whereas the feed and antenna honeycombs may each be square. The module honeycomb is rectangular in order to elevate support for the module to the center of the other square feed (input) and antenna (output) waveguide holes. This brings the microstrip to waveguide launcher to the appropriate location for efficient launching into the square tubes (Waveguides) of the antenna honeycomb 132. In general, the antenna/feed honeycomb waveguides may be any appropriate shape such as square, rectangular, round, etc.

Multilayer Wiring

FIGS. 14 and 15 also illustrates the multilayer wiring 140*a* and 140*b*. The wiring is in the form of printed circuit cards which are mechanically held in place by compression. The compressive force may be developed by screws at the outside edges of the array (e.g., see bolts 154 in FIG. 7), or by internal screws-wherein certain module positions are vacated for that use. The wiring sheet contains holes at the appropriate location to permit insertion of the electronic module 130 from either end through the sheet and into the module honeycomb 128. The wiring sheet is copper clad on both sides for good shielding and thermal conductivity and is subsequently plated with nickel/gold to prevent oxidation. Where contact pads are fixed to the surface, the area surrounding the contact pads are insulated to prevent shorting. The wiring sheet may wrap around so as to enclose all edges and cutouts and may or may not be copper plated within the interior of the cutout regions. The wrap-around feature improves thermal conductivity through the sheet and provides a path around the sheet at the module holes for waveguide current continuity.

The DC and logic connections for the electronics module 130 are located at non-interactive low impedance points relative to the module 130 RF input and output signals. Such an arrangement relaxes constraints on the multilayer wiring to the extent that the wiring may protrude up into the hollow waveguide space as seen in FIG. 15A. DC and logic interconnect wire dressing also becomes of less concern at the illustrated locations. All DC and logic signals distributed by the multilayer wiring sheets are shown connected to each module using gold wire bonds 230 connected between the module pins (200*a*, 200*b*, 202*a*, 202*b*) and pads 232 on each multilayer wiring 140*a*, 140*b*. Pads 232 are conducting terminals connected to the internal wiring in the multilayer wiring sheets; however, the pads are positioned in insulation islands on the surface of the multilayer wiring as otherwise they would short out. Rework and/or repair at the module level is enabled by removing either the antenna or feed honeycomb as necessary. The multilayer wiring sheets need not be removed.

The multilayer wiring sheet may be of the type usually used for printed wiring applications. The conductors material is usually copper with thicknesses ranging from 0.0005 to 0.003 inches. The metallization patterns are photo lithographically produced. The preferred dielectric is polyimide (kapton) which is available in similar thicknesses. The DC power for this embodiment is brought in on the multilayer wiring 140*a* adjacent the antenna honeycomb 132, and may be distributed using a single metal layer. Alternately, as in the preferred embodiment, two stacked metal layers may be employed to allow wider lines and reduce the ohmic line impedance.

FIG. 16 illustrates a representative portion of the metallization pattern of the multilayer wiring 140*a* for routing the +DC power via metallization pattern 234 and the −DC bias via metallization pattern 236. (For clarity, only some of the pads, indicated by dotted lines 232*a*, and some of the wire bonds 230 are illustrated in FIGS. 16 and 17). FIG. 16 shows the multilayer wiring 140*a* installed over the module honeycomb 128 with the electronic modules 130 in place for such a single layer distribution. The sheet may still be termed multilayer since two layers of polyamide are required, one on each side of the metallization patterns 234, 236 to insulate these metallization patterns form the outer copper metallization (not shown). Printed multilayer wiring 140*b* distributes clock and data signals to the electronics modules 130. Two internal copper signal layers are required, one forming a metallization pattern 238 for the clock signals, and the other forming a metallization pattern 240 for the data signals. FIG. 17 shows a sketch for such a distribution wherein metallization pattern 238 routes the clock signals to the pin 202*b* of the electronic module 130, and metallization pattern 240 routes the data signals to the pin 202*a* of the electronic module 130. The multilayer wiring 140*b*, is also enclosed with copper on both outside surfaces to shield the wiring and to insure RF (waveguide) continuity at cutouts where the electronic modules 130 are passed through.

Thermal Considerations

The thermal energy generated within the electronic module 130 is conducted through the carrier 170 down into the module honeycomb 128 where a relatively thick good conductivity wall exists to spread the heat and conduct it toward the feed honeycomb 134. The heat is conducted through the thin multilayer wiring sheet 140*b*, and then through the walls of the feed honeycomb 134. The heat crosses the feed honeycomb 134 and waveguide feed network 112 to where it is dissipated by the thermal interface 114 (see FIG. 7) using an appropriate cooling device such as, for example, a cooling fluid, evaporative cooling device (heat pipe), air cooled device etc.

The polyamide (kapton) dielectric within the multilayer wiring 140*b* is a poor thermal conductor. A method for reducing the thermal drop across the wiring sheet is to install copper plated vias 244 as shown in FIG. 17. As an example, twenty-four vias per module honeycomb tube 128*a* are shown to conduct heat through the wiring sheet 140*b*. Alternately, the holes may be plated full (plated through posts) to even further reduce thermal resistance. The array packaging approach provides a parallel low thermal resistance cooling path for each individual electronic module 130.

The dimensions for the 44 GHz electronic module 130 are approximately 0.75×0.10×0.05 inches for length, width, and thickness, respectively. The overall thickness for the phased array including the antenna and feed honeycombs is less than 2 inches.

Alternative Multilayer Wiring-to-Module Connections

The connections described above for feeding power and logic signals to the electronic module 130 employ multilayer wirings 140*a* and 140*b* (multilayer circuits) which have contacts that are permanently formed to contacts (pins) of the electronics module such as by metallurgical bonds (by soldering or thermo-sonic bonding). Such bonds must be broken when a module is removed from the array. The fabrication of new bonds between the replacement module and the multilayer wirings require special tools, and usually the application of heat.

However, modules must be replaced with great care to avoid damage to the multilayer wirings. If a multilayer wiring is damaged in the assembly, the bonds to all modules must first be cut and then redone after a new multilayer wiring is installed. It is expected that the repair operation for permanent bonds will be quite expensive and will prohibit repair in the field, thus requiring the antennas to be shipped to the factory for reconditioning after a number of modules have failed so that the antenna performance has become unacceptable.

A good electrical connection can be formed if two conductive surfaces are forced against each other with sufficient pressure. Gold-plated surfaces are superior because they are soft and free of a non-conductive or poorly conducting oxide layer. However non-conducting debris may nevertheless be deposited on the surfaces. Thus, in accordance with the principles of the invention, a wiping action to clean the mating surfaces is utilized together on the gold contact surfaces In general, the force between contact surfaces is usually generated by the elastic deformation of a spring-type metal. This occurs for example when a pin is inserted into a slightly undersized metal receptacle, or a printed wiring board into a slightly undersized slot between contact springs of an edge connector. This type of contact has the disadvantage that it requires a high force during insertion to overcome the friction which develops when the loaded contact surfaces slide on each other. However, this high insertion force is dangerous for pins, components, and structural elements.

In accordance with the principles of the invention, this insertion force can be eliminated if the contacts are first positioned close to each other in a state of rest, and then forced together by a mechanism external to the contacts (e.g., plates and bolts). The resulting zero insertion force (ZIF) concept is incorporated in the multilayer wiring-to-module connections of the phased-array antenna.

Contact force and resulting damage can also be reduced when stiff metal contacts are avoided. In other embodiments of the invention, an elastomeric conductive polymer strip, pad or sheet is placed between the metal surfaces. The conductive polymer pad is made of silicone rubber with uniformly spaced metal columns embedded. The columns allow conduction in the z-direction only (through the sheet) but not along the direction of the plan of the sheet. When placed between metal surfaces and lightly compressed, a reliable connection is made from metal surface to metal surface through the columns in the polymer, but not between adjacent pads. Compared with direct metal-to-metal contacts, the contact force can be reduced by 60% through the use of polymer strips. The reduction of the contact force allows a lighter mechanical support structure. These conductive sheets are per se known and described, for example, in (1) J. A. Fulton et al, "Electrical and Mechanical Properties of a Metal-Filled Polymer Composite for Interconnection and Testing Applications", IEEE Proceedings, 1989 Electronic Components Conference; (2) W. R. Lambert et al "Use of Anisotropically Conductive Elastomers in High Density Separable Connectors", IEEE Proceedings, 1989 Electronic Components Conference; and (3) K. S. Akkapeddi "The Design of Some Novel 0.0050-in Grid High-Density Circuit Pack-to-Backplane Connectors", IEEE Proceedings, 1989 Electronic Components Conference, all of which references are incorporated herein by reference.

In the alternate embodiments of the multilayer wiring-to-module connections, the permanently bonded connections of FIGS. 14–17 are replaced by pressure contacts, easily closed and opened, for example by the tightening of bolts.

The conductor traces in the module and on the flex circuits run on planes that are perpendicular to each other. If pins are attached to the module, the conductor planes on module and flex circuit become parallel which facilitates the establishment of pressure contacts.

FIGS. 18–23 illustrate alternative embodiments of the invention for separable connections for phased-array antennas with parallel conductor planes. In FIG. 18A an end of a module contact 260 is secured to the carrier 170 via an insulated spacer 262, and makes contact with contact pad 264 similar to the contact pads 232 of FIGS. 15–17. Contact pad 264 is secured to the multilayer wirings 140*a*, 140*b* in a portion thereof which is insulated from the otherwise conductive surface of the multilayer wiring, e.g., an insulated island. These pads 264 thus only connect to the desired metallization within the multilayer wiring and not to the outer conductive surface of the multilayer wiring itself. Optionally, located behind the contact pad 264 is a pressure pad 266 made of an elastomeric material.

Although only one spring-like module contact 260 for each multilayer wiring 140*a*, 140*b* is shown, it is understood that two such contacts are employed since each multilayer wiring brings two separate electrical lines into the electronic module 130. Multilayer wiring 140 carries the +V, −V dc voltages and multilayer wiring 140*b* carries the clock and data signals. Thus, a total of four spring-like contacts are employed. Further, it will be recalled that the ground connections are made through the metallic structures of the honeycombs 128, 132, and 134 to an outside ground terminal. Alternately, these multilayer wirings spring-like contacts may be used to bring in both power ground and signal ground to the electronics module. (The grounds are desirably made equal although they need not necessarily be so). In such cases, there are a total of six contacts (three for each side) between the multilayer wirings 140*a*, 140*b* and the electronics module 130.

Figure 18A:
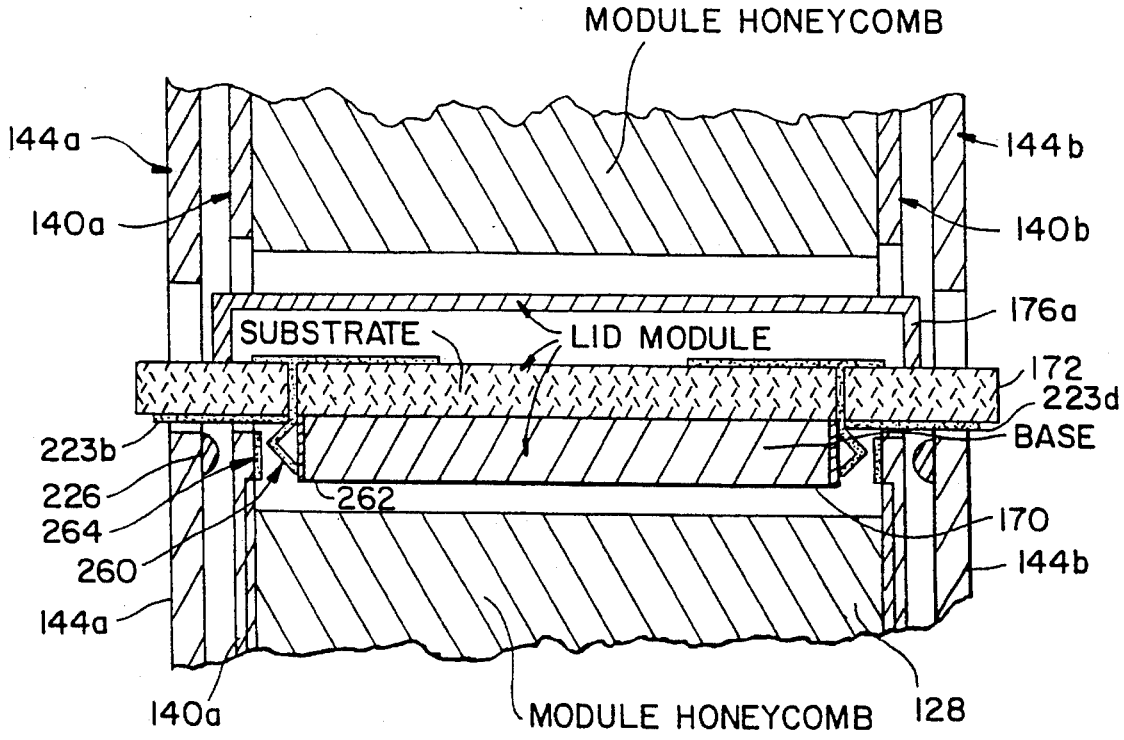
FIG. 18A is a cross sectional view of a power and logic connection mechanism using a zero insertion force arrangement.
Figure 18B:
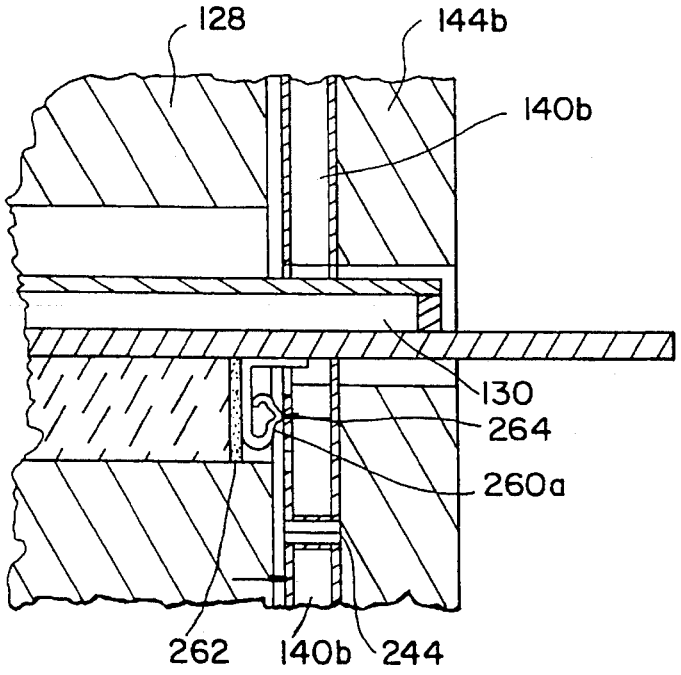
FIG. 18B shows a modification of the spring like contacts of FIG. 18A.

FIG. 18B is similar to that of FIG. 18A but illustrates a module contact 262*a* which is one of many different designs which are possible to provide a spring-like contact to give a wiping action. Also in FIG. 18B, the pressure pad 266 is omitted; however, there is illustrated one of the many copper plate thermal vias 244 through the multilayer wiring 140*b*. These vias are omitted from FIGS. 14A, 18A, 19, 20, 21A, 22 and 23 for clarity of illustration.

Figure 19:
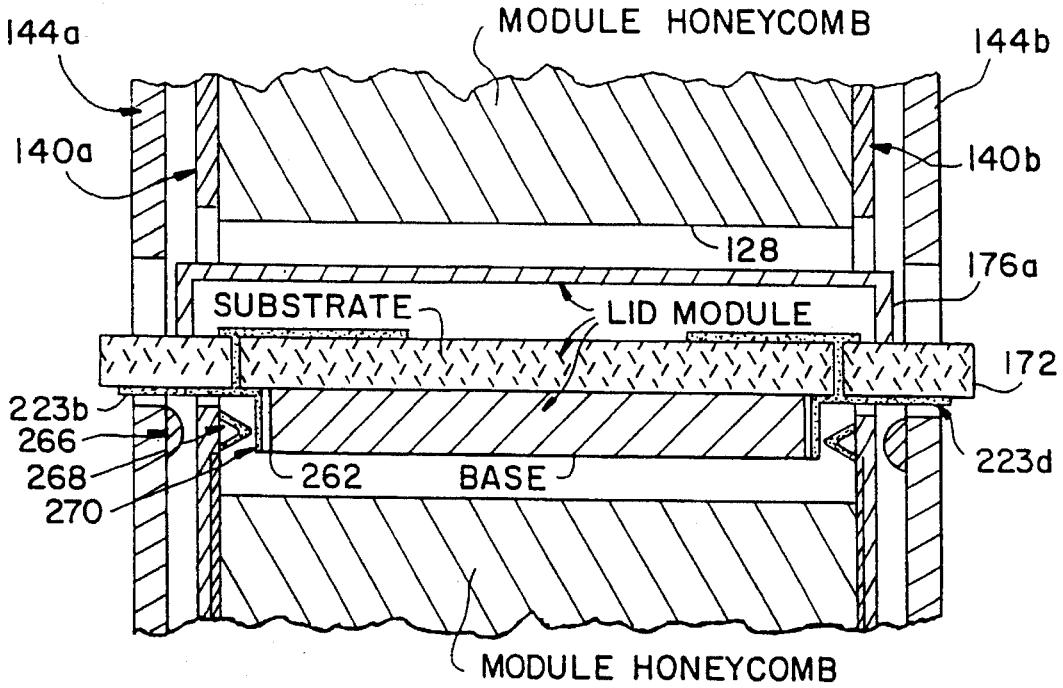
FIG. 19 is a cross sectional view of another embodiment of the power and logic connection mechanism using a zero insertion force arrangement.

FIG. 19 is similar to the embodiment of FIG. 18A but the module contact 260 is now replaced with a flex contact 268 secured to insulated islands of the multilayer wirings 140*a*, 140*b*. Moreover, a module contact pad 270 is now secured to the carrier 170 via insulated spacer 262. Both the module contact 260 (FIG. 18) and the flex contact 268 are resilient contacts to provide a spring bias.

Metal contact surfaces touch each other in the configurations of FIGS. 18 and 19. The formed spring contacts (contacts 260 and 268) move laterally when compressed providing the desirable wiping action. The module carrier 170 supports the pressure required for closing of the contacts. Closure is effected by means of compression forces applied, for example, with bolts (not shown). Although these figures only illustrate a cross sectional view of the termination structure, it should be apparent that separate contacts 260, 268 are provided for each electronic signal desired to be fed from the multilayer wiring 140*a*, 140*b* into the electronic module 130.

Figure 20:
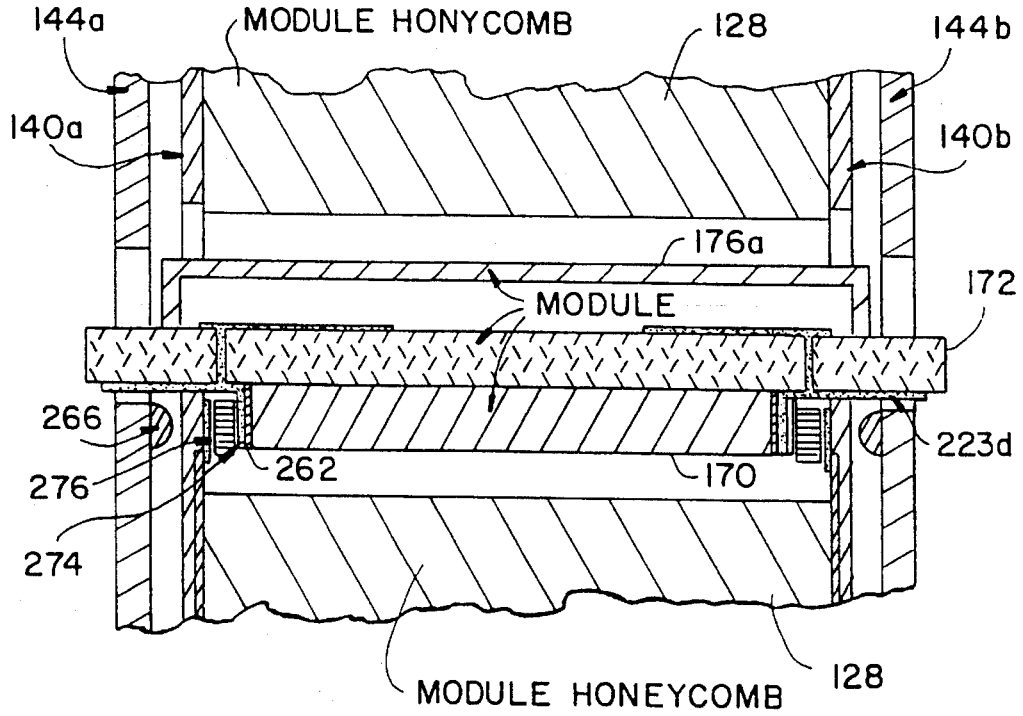
FIGS. 20, 21A and 21B show yet further embodiments of the power and logic connection mechanism.

In the embodiment of FIG. 20, the spring-like contacts 262 and 268 of FIGS. 18 and 19 respectively are replaced with a conductive polymeric pad 272 (of the type described above and more particularly described in the above referenced articles) placed between a module contact terminal or pad 274 and a flex contact terminal or pad 276. The wiping action of the spring-like contacts is not required with the elastomeric pad embodiment.

Figure 21A:
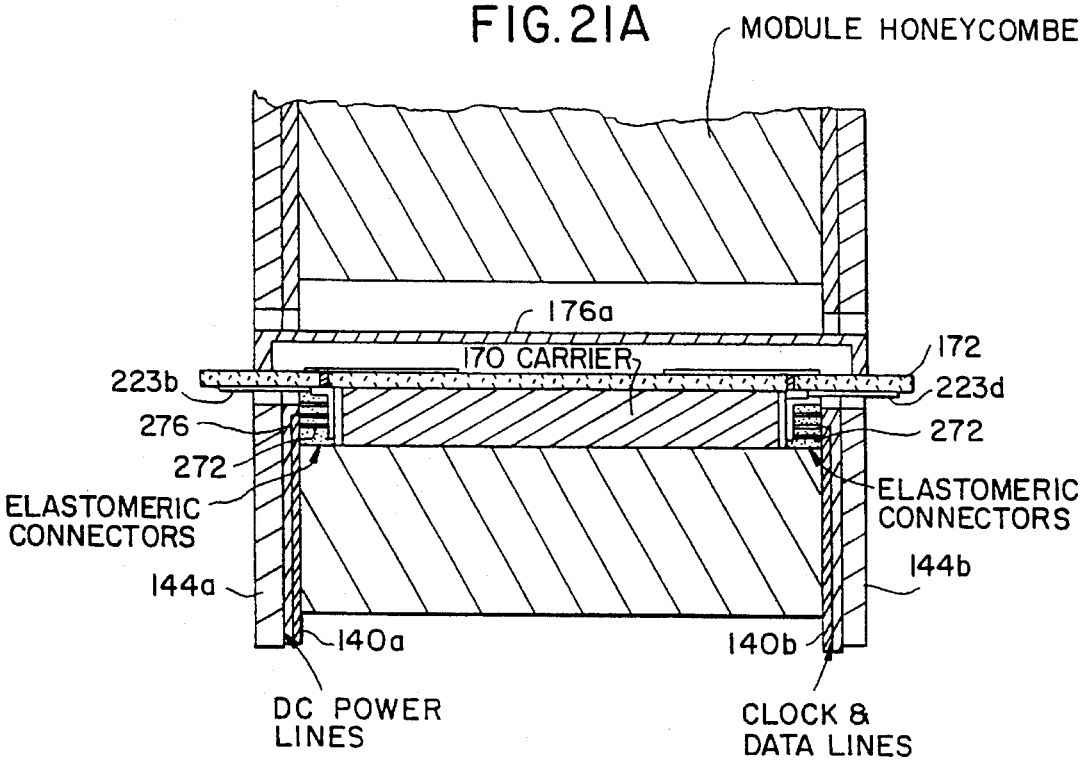
Figure 21B:
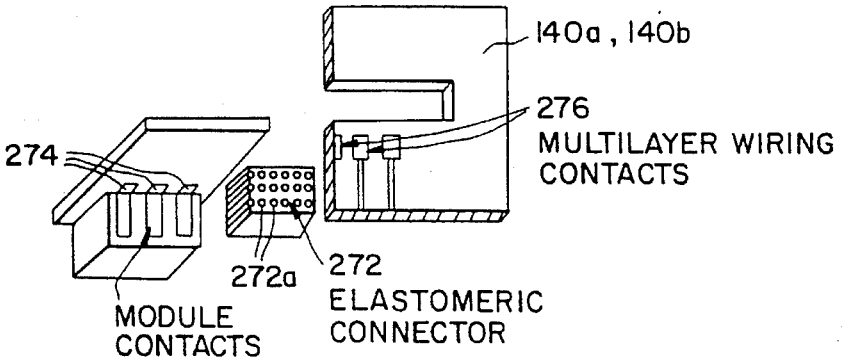

FIGS. 21A and 21B illustrate an embodiment of the invention similar to that of FIG. 20 but without the elastomeric pressure pad 266. In FIG. 21A the pressure plates 144*a*, 144*b* have been compressed to bring all contact elements into contact with one another. Thus, the flex contact pads 276 of the multilayer wirings 140*a*, 140*b* are in contact with the conductive elastomeric pad 272 which in turn is in contact with the module contact pads 274 mounted on the carrier 170 of the electronic module 130.

FIG. 21B shows an exploded view of the three contact elements. In FIG. 21B, the module contact pads 274 have first and second portions 274*a*, 274*b* respectively contacting the bottom surface of the substrate 172 and the side or end of the carrier 170. These contact pads are insulated from one another by means of an insulating layer (spacer 262 shown in FIG. 20). Thus, contact is made to the desired via on the underside of the substrate 172. Also, FIG. 21B illustrates the three contact embodiment of the invention in which a power (+5 V, −5 V) and signal ground are brought into the electronic module 130 by means of the multilayer wirings 140*a*, 140*b*. The single conductive polymeric pad 272 (which may be elastomeric) is sufficient to make contact with each of the three flex contacts pads 276 and their corresponding module contact pads 274 since the pad 272 is composed of a plurality of conductive pathways 272*a* which are insulated from one another and only permit conduction in a single axial direction, e.g. the z axis, or horizontally as seen in FIG. 21A. The pads 272 may be made somewhat larger than the spacing into which they fit adjacent the carrier 170 of the electronic module 130. In this fashion, the pads 272 will remain in place even when the multilayer wirings 140*a*, 140*b* are removed for repair/replacement of a damaged module 130.

Figure 22:
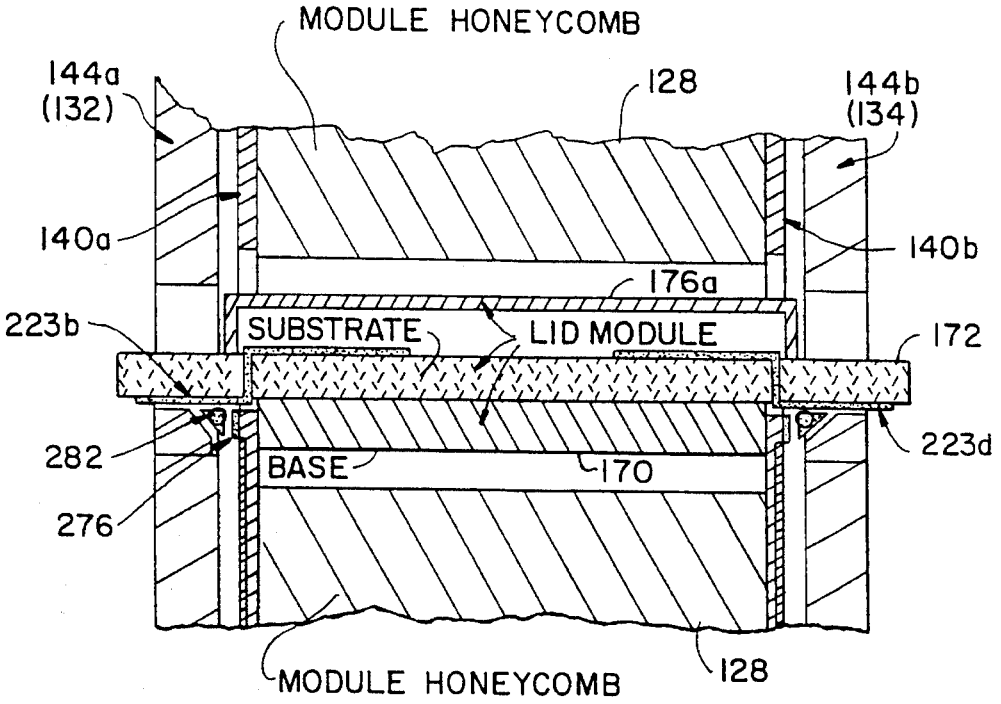
FIGS. 22 and 23 illustrate additional embodiments of the power and logic connection mechanisms.
Figure 23:
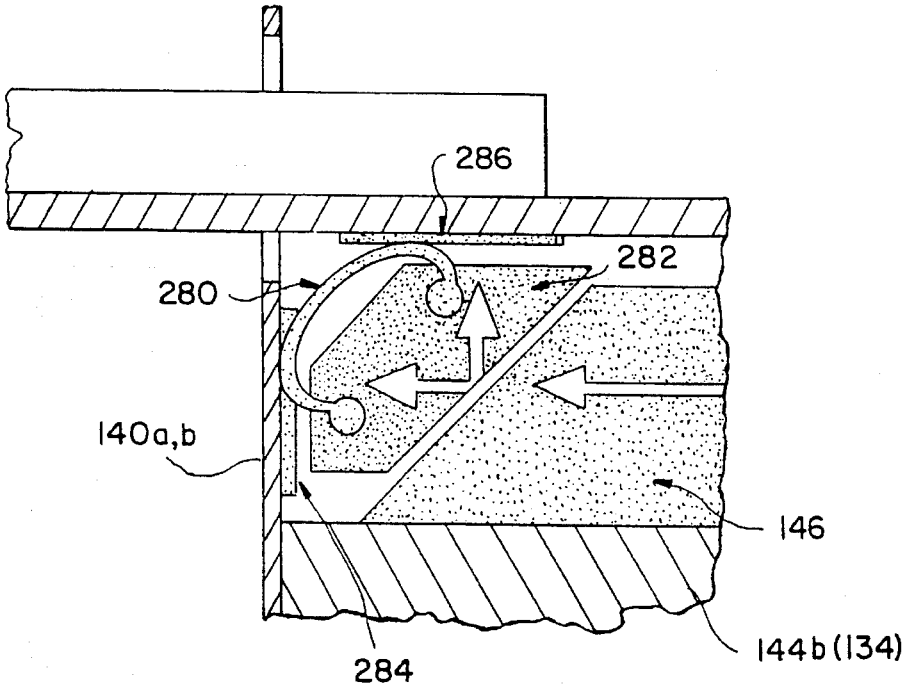

FIGS. 22 and 23 show another embodiment of the invention in which the principle of a pressure contact is applied to a module without pins when the terminal pads are on perpendicular planes. FIG. 23 is an enlarged view of the a portion of the contact elements of FIG. 22. In this embodiment, a metal spring 280, which may be gold plated, is embedded in an elastomeric block to form a wedge 282. The metal spring 280 makes contact between a flex contact pad 284 and a module contact pad 286. As before, there are actually a minimum of two such springs 280, flex contact pads 284 and module contact pads 286 for each side of the module 130 (for each multilayer wiring 140*a*, 140*b*) and possibly three such contacts in the case ground is also brought in through the multilayer wirings 140*a*, 140*b*. It is sufficient to use a single wedge (which is non-conducting) to secure each of the two or possible three metal springs 280. When the pressure plates 144*a*, 144*b* are tightened, the wedge 282 creates contact pressure against both the flex and module contact pads which are perpendicular to one another. The metal spring 280 forms a bridge between the surface pads on module and flex circuit without being attached. Further, the deformation of the metal spring 280 creates a wiping action on the pads 284, 286.

Yet another embodiment of the inventions may be described in relation to FIGS. 22 and 23. In this embodiment (as well as in the embodiments of FIGS. 18–21), the pressure plates 144*a*, 144*b* are optional. If these pressure plates are not used, their function is taken up by the adjacent antenna or feed honeycombs. For example, the function of the pressure plate 144*a* is taken up by the surface of the antenna honeycomb 132 which faces the module honeycomb 128. Similarly, the surface of the feed honeycomb 134 which faces the module honeycomb 128 takes up the function of the pressure plate 144*b*. This alternative embodiment is shown in FIGS. 22 and 23 with the designation 144*a* (132) used to indicate that either the pressure plate 144*a* and antenna honeycomb 132 may be used in combination or that the antenna honeycomb 132 may be used alone without the pressure plate 144*a*. Similarly, the designation 144*b* (134) is used to indicate that either the pressure plate 144*b* and feed honeycomb 134 may be used in combination or the feed honeycomb 134 may be used alone without the pressure plate 144*b*. If the pressure plates are not used, the dielectric 146 from the feed honeycomb 134 and antenna honeycomb 132 makes contact with the wedge 282. Clearly, one could also employ an embodiment in which only one of the pressure plates 144*a*, 144*b* is used with the function of the other pressure plate taken up by either the antenna honeycomb 132 or the feed honeycomb 134 whichever has no corresponding pressure plate.

It is noted that in FIGS. 18–23 the memory metal wedge is omitted for clarity of illustration. Further, in FIGS. 18–20 and 22, the electronic module 130 is shown spaced apart from the walls of the module honeycomb and from the multilayer wirings to better illustrate the DC and logic connectors.

In the embodiments of FIGS. 18–23, contact pressure is developed when the pressure plates are tightened against the module honeycomb. Contact pressure variations due to mechanical tolerances are reduced by the use of elastomer cushions, such as elastomeric pressure pad 266, used to force the flex circuits (multilayer wirings) against the module terminations. These pressure pads are preferably positioned in alignment with the terminations to give maximum effect. A single pressure pad may be used for each side of the electronic module 130, or a plurality of pads may be used for each side.

The embodiments described in FIGS. 18–23 allows electronic modules 130 to be inserted into the phased-array antenna system without special tools or the application of heat. This "plug-in" feature, used to provide separate ohmic connection or DC and logic, is particularly advantageous with the relatively small module sizes appropriate for the millimeter wavelength range. Moreover, the design isolates the DC connections from the region where RF fields are present, and improves the performance uniformity of the embedded modules.

Figure 24:
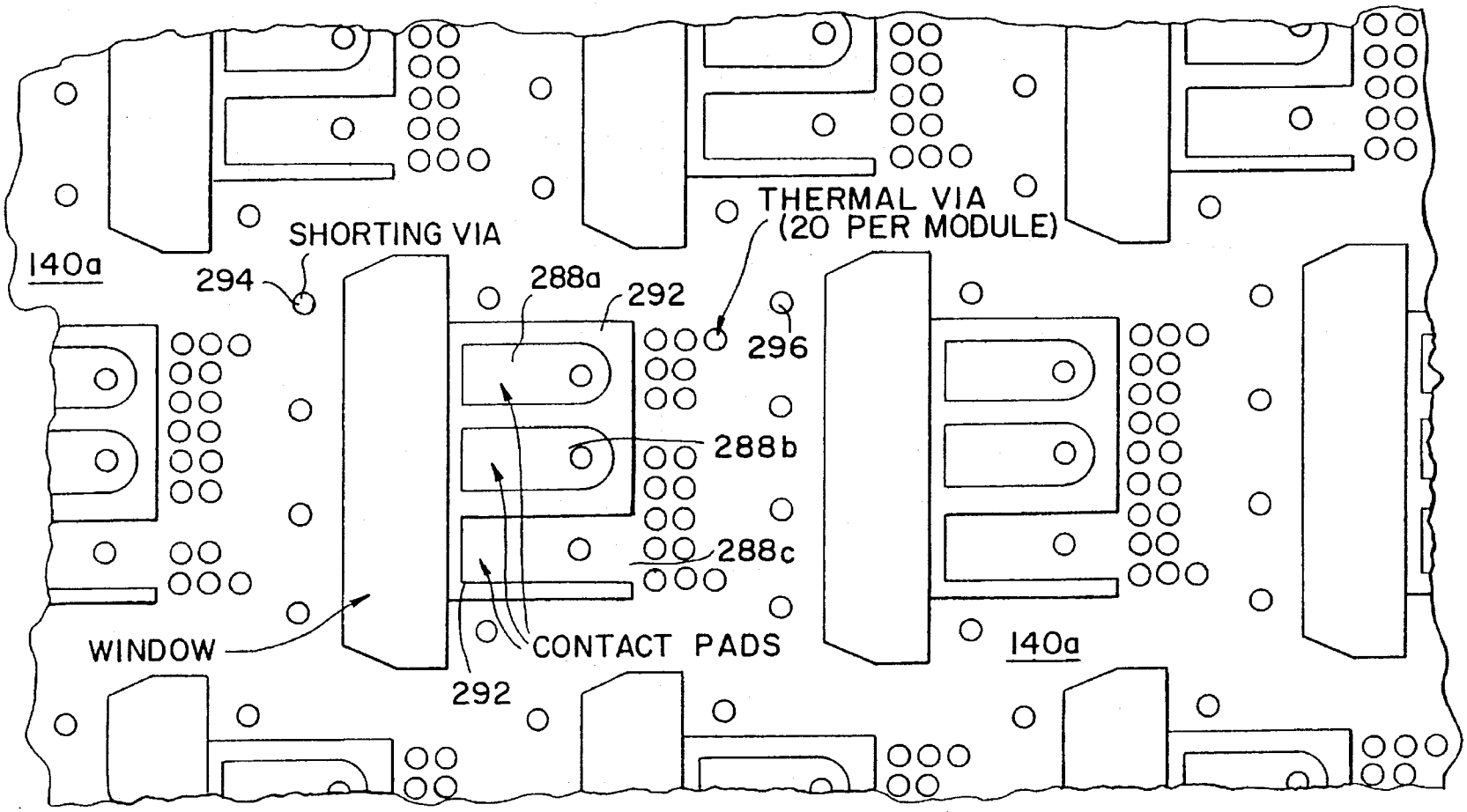
FIGS. 24 and 25 depict multilayer wiring circuit metallization patterns for the embodiments of FIGS. 21A and 21B.
Figure 25:
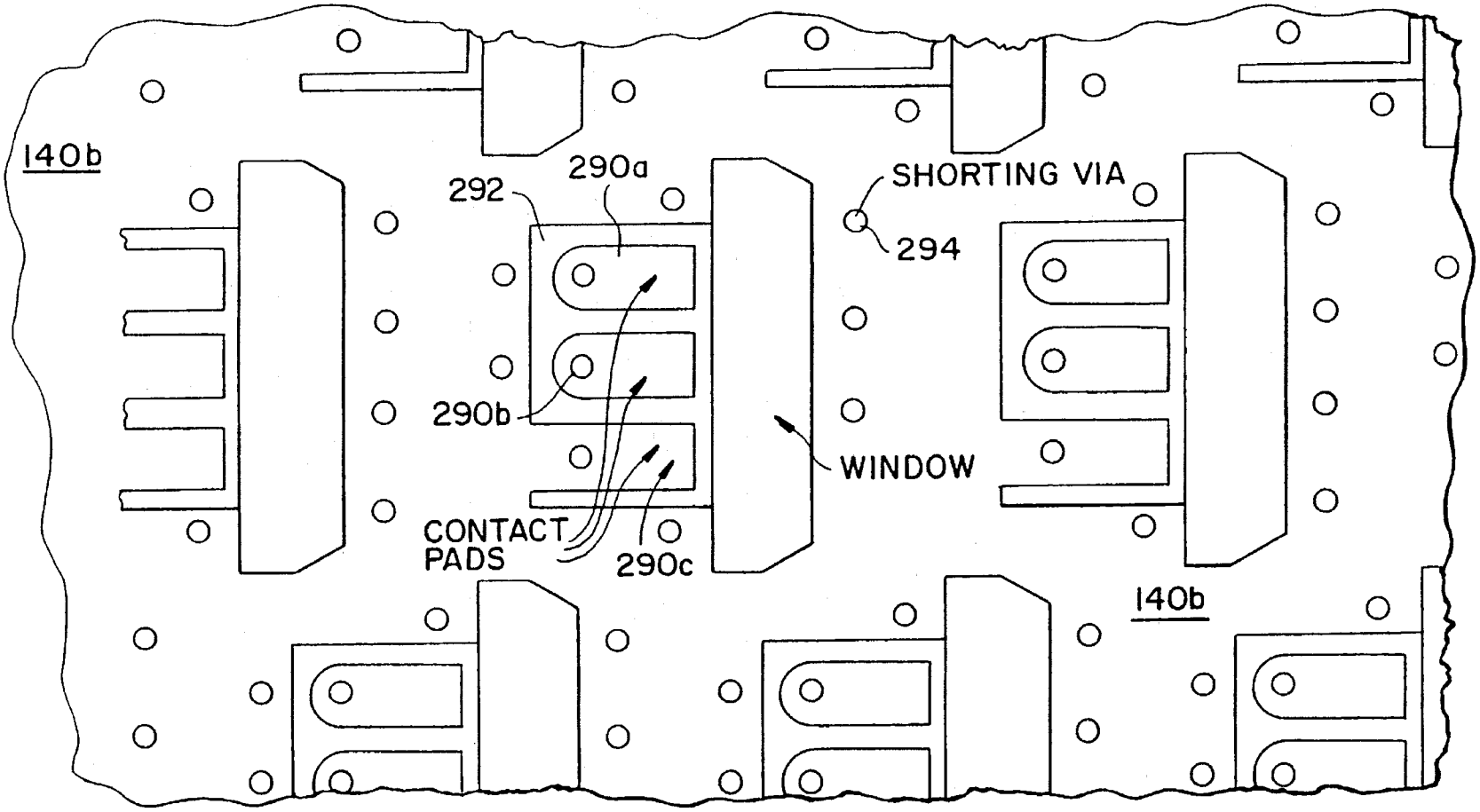

FIGS. 24 and 25 illustrate a circuit detail for the multilayer wiring 140*a* (power) and 140*b* (logic) respectively for the case in which ground is also brought in through the multilayer wiring. These figures are similar to FIGS. 16 and 17 respectively. The exposed copper surfaces of the multilayer wiring are protected against oxidation and corrosion by gold plating with a diffusion barrier between the gold and copper. The multilayer wiring contains the two outer groundplane surfaces and two internal layers have internal metallization patterns forming vertical and horizontal traces. Windows are cut out in each multilayer wiring circuit to permit part of the electronic module 130 to protrude therethrough. Three contact pads 288*a*, 288*b* , and 288*c* are formed on the surface of the multilayer wiring 140*a* facing electronic module 130. In FIG. 24, contact pads 288*a* and 288*b* are for DC power and contact pad 288*c* is for ground. The ground contact pad connects with the exterior groundplane of the multilayer wiring 140*a*. In FIG. 24 contact pads 290*a* and 290*b* correspond to the clock and data terminals and contact pad 290*c* is signal ground, equal to power ground. An insulation region 292 isolates the contact pads 288*a*, 288*b* and 288*c* on multilayer wiring 140*a* and similar insulation regions 292 are provided on multilayer wiring 140*b*. Shorting vias 294 are located around each window and are provided to electrically connect each groundplane together from the opposite sides of the multilayer wiring. Further, a plurality of thermal vias 296 (similar to vias 244 of FIG. 17) are provided in the multilayer wiring 140*a* to conduct heat to the thermal interface 114 (see FIG. 7). The vias may be plated with copper although solid copper filling of the vias is preferred. Metal in the thermal vias is connected with the exterior groundplanes of the multilayer wirings to allow metal-to-metal heat transfer. Thermal vias are not utilized in FIG. 25 for the multilayer wiring 140*b* since heat is only transferred optimally out to the thermal interface 114.

Multiple Radiation Channel Alternative

In the packaging approach described, a single module per radiating element is employed. This approach could be extended to include multiple radiating elements served by a single module. If so configured, each module would have multiple channels, multiple input noncontacting RF transitions (one for each channel) and multiple output RF transitions (one for each radiator served). The input and output ceramic card would be slit to enable each transition to be inserted into the appropriate honeycomb waveguide. The number of segments required on each end would be equal to the number of radiating elements served by each module. In this embodiment, the module would be considerably more complex; however, many of the advantages of the invention would still remain. Each channel remains completely testable. The thermal model for the array system would be slightly degraded since some of the metal in the module honeycomb would not be there. The manufacturing yield for the more complex module assembly would be less. Also, if the isolation between the individual channels contained within each module were inadequate, array performance would be impacted. The benefits that might result from such a packaging approach would come from a reduced number of modules that need to be handled and from the extra room made available by eliminating the interior walls between module channels.

Advantages and Features

The electronic module has a number of distinct advantages. One of the most significant and important feature is the potential for low cost. The hermetically sealed module consists of only three major components, the carrier 170, the substrate 172, and the module lid 176 (cover 176*a*). The entire electronic module 130 is available using existing materials and processing technology. No relatively expensive ceramic to ceramic hermetic seals are required. The three major components are arranged in a way that is "self packaging" in that they eliminate the need for any other shell. The easily assembled package is highly repeatable in RF performance. The manufacturing yield is expected to be high, and breakage during testing and qualification should be low since the package is relatively robust. The unique overhang design (the substrate extensions 172*a* and 172*b*) for the electronics module 130 brings DC, and logic connections out through the ceramic substrate 172 at a location, relative to the waveguide transition employed, where the coupling with RF fields will be minimized. The unique overhang design also enables the transitioning of the RF from inside the module to the outside in any number of low cost efficient and repeatable means. The use of pins for DC and logic interconnects in this application is also considered advantageous where wire bonding is used for DC and logic interconnections.

The split honeycomb arrangement, using separate antenna, module and feed honeycomb structures, is another important aspect of the invention. Such an arrangement permits the various honeycomb layers to have different prescribed hole shapes. It enables a replacement electronic module 130 to be electrically attached to the multilayer wirings 140*a* and 140*b* at locations where the RF coupling into the DC and logic wiring is minimized and enables the fabrication of different interior shapes required to position the electronic module 130 and to facilitate the removal of heat. The split honeycomb provides the back short for the module microstrip line to waveguide transition at a location that is precisely located which will translate into consistent performance since the location is identical for all modules and not subject to assembly tolerances. Locating the multilayer wiring and module interconnect where the RF fields are low relaxes the printed wiring tolerances and enables the use of relatively thick multilayer wiring. This substantially reduces the DC power line resistance and enables higher powered modules.

The use of the memory metal attachment device or wedge 222 is particularly advantageous in the preferred embodiment of the invention. The memory metal wedge 222 insures that the electronic module 130 will not move until purposely pressed out at some future date for module removal/repair. The memory metal also insures that the heat generated within the module will be efficiently removed by maintaining the pressure required to insure a low thermal resistance between the electronic module an the module honeycomb structure.

In connection with FIGS. 18–23, the invention permits a simplification of the array assembly over the wire bond embodiments of, for example, FIG. 15A. FIGS. 18–23 employ a zero-insertion-force (ZIF) edge connection to the multilayer wirings 140*a*, 140*b* at each module location for ease of hookup and maintenance. Thus one may avoid the use and risk (both in assembly and maintenance) of using the DC and logic bond wires. Further, these embodiments do not use conventional connector designs consisting of a dielectric structure which holds and supports the connector contacts. Such conventional connectors require more parts and would increase the assembly risk. The design of the invention improves DC and RF isolation since the DC connections are shielded from RF fields by the contact pressure plate. Moreover, the components of the invention are fabricated using established technology, and each module can be tested for DC and logic connections prior to installation of the external and internal honeycomb, after the multilayer wiring and pressure plates have been installed.

Repairability of the embodiments shown in FIGS. 18–23 is also improved because each of the multilayer wirings are supported by a stiff pressure plate. Thus, the risk of repair induced damage is reduced, especially when compared to wire bonding of connections. The multilayer wiring circuits are easily removed exposing all modules for individual removal.

The use of the embodiments of FIGS. 18–23 has the advantage of providing a low risk of non-availability of component parts. The multilayer flex circuits utilize conventional technology which reduces availability risks and therefore cost. The pressure plates 144*a* , 144*b* may serve as ground reference planes. Alternately, the "windows" or cut-outs in the multilayer wirings (for the module extensions to pass through) employ wrap-around plating so that the multilayer wirings themselves become the wave aide back short. Further, as in conventional technology, propagation of RF energy along the multilayer wiring may be controlled by a few carefully placed plated-through vias. Other plated-through vias may be used to improve the thermal impedance for heat flow through the multilayer wiring.

Certain advantages also flow from using the pressure plates 144*a*, 144*b*. The clamping of the multilayer wiring with the pressure plate to the module honeycomb simplifies array assembly, maintenance, and testing. After the multilayer wiring and pressure plates are attached to the module honeycomb, each electronic module 130 can be tested for DC and logic connections prior to the fastening of the external and internal honeycomb. The pressure plates improve the isolation of DC and RF because all DC and logic connections are shielded from RF fields by the pressure plates. Further, the pressure plates define a consistent RF back plane short. No back short movement can be induced by the assembly process or by thermal cycling. The RF back short obtained with the pressure plates constitute an improvement because the plates cover more of the module openings in the module honeycomb as compared to the embodiments using the wire bonds, e.g., FIG. 15A, since in these wire bond embodiments a larger window in the multilayer wiring must be provided to enable removal of any given damaged electronic module 130 and insertion of a new one without disconnection and removing the multilayer wiring from all of the non-damaged electronic modules 130.

While the invention has been described in reference to preferred embodiments of the invention, various modifications and improvements will be apparent to those of skill in the art. The invention is intended to cover all such modifications and improvements as fall within the scope of the appended claims.

What is claimed is:

1. An apparatus for coupling electro-magnetic (EM) energy between a waveguide through which said EM energy propagates and an electronics unit, comprising:

a printed dipole antenna;

a coupled coplanar strip transmission line connected to said printed dipole antenna;

a slotline connected to said coupled coplanar strip transmission line, said EM energy being transferred between said waveguide and said slotline via said printed dipole antenna; and a microstrip transmission line integral to said electronics unit and physically isolated from said slotline, said EM energy being coupled between said slotline and said microstrip transmission line, wherein said printed dipole antenna and said electronic unit are disposed within said waveguide.

2. An apparatus as recited in claim 1 further comprising a module containing said printed dipole antenna, said coupled coplanar strip transmission line, said slotline and said microstrip transmission line.

3. An apparatus as recited in claim 2 in which no physical electrical contact exists between said waveguide and said module.

4. An apparatus as recited in claim 2 wherein said module comprises:

a substrate containing electronic elements including at least said electronics unit;

a carrier for supporting said substrate;

a lid secured to a top surface of said substrate and hermetically sealing electronic elements therein;

said substrate having an extension region on at least one end thereof, said extension region extending beyond the end of the carrier.

5. A coupling apparatus as recited in claim 4 wherein said printed dipole antenna and said slotline are positioned on one side of said extension region and said microstrip transmission line is positioned on an opposite side of said extension region, thereby coupling said EM energy between said waveguide and said microstrip transmission line without direct metal-to-metal contact between said waveguide and said substrate.

6. A coupling apparatus as recited in claim 4 wherein said microstrip transmission line is hermetically sealed by said lid and said microstrip transmission line supplies said electronic elements with said coupled EM energy.

7. A phased array antenna structure comprising:

a) a distribution network for distributing electromagnetic (EM) energy;

b) a feed honeycomb structure positioned adjacent said distribution network and connected to receive the EM energy from the distribution network;

c) a module honeycomb structure positioned adjacent said feed honeycomb structure so as to receive EM energy from said feed honeycomb structure;

d) an antenna honeycomb structure positioned adjacent said module honeycomb structure on a side opposite said feed honeycomb structure so as to receive EM energy from said module honeycomb structure;

e) each of said feed, module and antenna honeycomb structures have a plurality of aligned waveguides for transmitting EM energy therealong;

f) said module honeycomb structure including an electronic module for each waveguide, each electronic module having an electronic element for adjusting at least the phase of said EM energy and transmitting the adjusted phase EM energy to the aligned waveguide of the antenna honeycomb structure and g) at least a first printed dipole antenna positioned on said module to couple EM energy between said waveguide and said electronic module.

8. A phased array antenna structure as recited in claim 7, further comprising a multilayer wiring circuit positioned between at least one of (1) said feed honeycomb structure and said module honeycomb structure and (2) said antenna honeycomb structure and said module honeycomb structure, for providing electrical signals to each of said electronic modules.

9. A phased array antenna structure as recited in claim 8, wherein each of said electronic modules comprises:

a substrate for supporting said electronic element;

a carrier for supporting said substrate;

a lid secured to a top surface of said substrate and hermetically sealing the electronic element therein;

said substrate having metallization patterns thereon connected to said electronic element, and having an extension region on at least one end thereof, said extension region extending beyond the end of the carrier, said extension region including metallization patterns on the top surface thereof and vias extending from the top surface of said substrate to the bottom surface thereof in the extension region for receiving said electrical signals;

a plurality of terminals connected to the bottom surface of said substrate in the extension region thereof, said terminals connected to said vias for providing said electrical signals to the electronic element of said electronic module.

10. A phased array antenna structure as recited in claim 9, wherein said electrical signals includes power and logic signals and wherein said substrate has a first and second extension region on opposite sides of said electronic element and at least some of said metallization patterns and vias extend to said first extension region and at least others of said metallization patterns and vias extend to said second extension region, and said phased array antenna structure further comprising:

a first and second multilayer wiring circuit, said first multilayer wiring circuit positioned between said feed honeycomb structure and said module honeycomb structure and the second multilayer wiring circuit positioned between said antenna honeycomb structure and said module honeycomb structure, said first multilayer wiring circuit carrying one of said power and logic signals and the second multilayer wiring circuit carrying the other of said power and logic signals.

11. A phased array antenna structure as recited in claim 10, wherein said first extension region at least partially extends within said feed honeycomb structure and second extension region at least partially extends within said antenna honeycomb structure and wherein said first printed dipole antenna is positioned on said first extension region for coupling said EM energy from said feed honeycomb structure to said electronic element without direct metal-to-metal contact; and a second printed dipole antenna is positioned on said second extension region for coupling said EM energy from said electronic element to said antenna honeycomb structure without direct metal-to-metal contact.

12. A phased array antenna structure as recited in claim 11 further comprising:

a microstrip transmission line positioned on each of a first surface of said substrate and coupled directly to said electronic element;

a slotline for each said printed dipole antenna positioned on a second surface of said substrate, said slotline coupling said EM energy between each said printed dipole antenna and said microstrip transmission line.

13. An apparatus for transferring EM energy between a waveguide and an electronics unit, comprising:

a printed dipole antenna, said printed dipole antenna and said electronics unit being inserted into said waveguide and coupling said EM energy between said waveguide and said printed dipole antenna;

a slotline directly connected to said printed dipole antenna; and a microstrip transmission line within the electronics unit and physically isolated from said slotline, said EM energy being transferred between said waveguide and said microstrip transmission line via said printed dipole antenna.

14. An apparatus as recited in claim 13 further comprising a substrate, wherein said printed dipole antenna and said slotline are printed on one side of said substrate and said microstrip transmission line is printed on an opposite side of said substrate.

15. An apparatus as recited in claim 14 wherein no physical electrical connection exists between said waveguide and said substrate.

16. An apparatus as recited in claim 15 wherein said electronics unit further comprises electronic elements mounted on said substrate and connected to said microstrip transmission line, said electronic elements receiving said EM energy from said microstrip transmission line.

17. An apparatus as recited in claim 15 wherein said electronics .unit further comprises electronic elements mounted on said substrate and connected to said microstrip transmission line, said electronic elements transmitting said EM energy to said microstrip transmission line.

18. A method for transferring electromagnetic (EM) energy between a waveguide for propagating EM energy and an electronics unit including a microstrip transmission line, comprising the steps of:

disposing said electronics unit within said waveguide; and coupling said EM energy between said waveguide and said microstrip transmission line via a printed dipole antenna, wherein said printed dipole antenna is disposed within but physically isolated from said waveguide and wherein no physical electrical connection is formed between said printed dipole antenna and said microstrip transmission line.

19. A method as recited in claim 18 wherein said coupling step further comprises the step of coupling said EM energy between a slotline having a physical electrical connection to said printed dipole antenna and said microstrip transmission line, wherein no physical electrical connection is formed between said microstrip transmission line and said slotline.

* * * * *